US010910699B2

(12) United States Patent
Puente et al.

(10) Patent No.: US 10,910,699 B2
(45) **Date of Patent: *Feb. 2, 2021**

(54) SLIM TRIPLE BAND ANTENNA ARRAY FOR CELLULAR BASE STATIONS

(71) Applicant: CommScope Technologies LLC, Hickory, NC (US)

(72) Inventors: Carles Puente, Barcelona (ES); Carmen Borja, Barcelona (ES); Anthony Teillet, Trabuco Canyon, CA (US); Dillon Kirchhofer, Taylorsville, KY (US); Jaume Anguera, Vinaros (ES)

(73) Assignee: CommScope Technologies LLC, Hickory, NC (US)

( * ) Notice: Subject to any disclaimer, the term of this patent is extended or adjusted under 35 U.S.C. 154(b) by 197 days.

This patent is subject to a terminal disclaimer.

(21) Appl. No.: 15/977,795

(22) Filed: May 11, 2018

(65) Prior Publication Data

US 2018/0261910 A1 Sep. 13, 2018

Related U.S. Application Data

(60) Division of application No. 15/232,160, filed on Aug. 9, 2016, now Pat. No. 10,211,519, which is a (Continued)

(30) Foreign Application Priority Data

Oct. 14, 2005 (EP) ..... 05109585

(51) Int. Cl.
*H01Q 21/00* (2006.01)
*H01Q 1/38* (2006.01)
(Continued)

(52) U.S. Cl.
CPC ..... *H01Q 1/246* (2013.01); *H01Q 1/42* (2013.01); *H01Q 1/48* (2013.01); *H01Q 5/307* (2015.01);
(Continued)

(58) Field of Classification Search
CPC ..... H01Q 1/246; H01Q 1/48; H01Q 21/30; H01Q 21/065; H01Q 1/42; H01Q 5/42;
(Continued)

(56) References Cited

U.S. PATENT DOCUMENTS 3,605,102 A 9/1971 Frye
3,818,490 A 6/1974 Leahy
(Continued)

FOREIGN PATENT DOCUMENTS

EP 0688040 12/1995
EP 0817310 1/1998
(Continued)

OTHER PUBLICATIONS

Anguera , J., Fractal and broadband techniques on miniature, multifrequency and high-directivity microstrip patch antennas, Universitat Politecnica de Catalunya (UPC), May 1, 2003.
(Continued)

*Primary Examiner* — Trinh V Dinh
(74) *Attorney, Agent, or Firm* — Myers Bigel, P.A.

(57) ABSTRACT

A triple-band antenna array for cellular base stations operates at a first frequency band and at a second frequency band within a first frequency range, and also at a third frequency band within a second frequency range. The triple-band antenna array comprises a first set of radiating elements operating at the first frequency band, a second set of radiating elements operating at the second frequency band, a third set of radiating elements operating at both the third and the first frequency bands, and a fourth set of radiating
(Continued)

elements operating at both the third and the second frequency bands. The radiating elements are arranged such that at least some of the radiating elements of the first and third sets are interlaced, and at least some of the radiating elements of the second and fourth sets are interlaced.

16 Claims, 21 Drawing Sheets

Related U.S. Application Data continuation of application No. 14/282,488, filed on May 20, 2014, now Pat. No. 9,450,305, which is a continuation of application No. 13/933,636, filed on Jul. 2, 2013, now Pat. No. 8,754,824, which is a continuation of application No. 12/089,751, filed as application No. PCT/IB2006/002975 on Oct. 12, 2006, now Pat. No. 8,497,814.

(60) Provisional application No. 60/727,981, filed on Oct. 18, 2005.

(51) Int. Cl.

| | |
|---|---|
| ***H01Q 1/24*** | (2006.01) |
| ***H01Q 9/04*** | (2006.01) |
| ***H01Q 21/08*** | (2006.01) |
| ***H01Q 5/307*** | (2015.01) |
| ***H01Q 5/50*** | (2015.01) |
| ***H01Q 5/42*** | (2015.01) |
| ***H01Q 1/42*** | (2006.01) |
| ***H01Q 21/06*** | (2006.01) |
| ***H01Q 21/30*** | (2006.01) |
| ***H01Q 1/48*** | (2006.01) |

(52) U.S. Cl.
CPC ..... *H01Q 5/42* (2015.01); *H01Q 5/50* (2015.01); *H01Q 9/0414* (2013.01); *H01Q 9/0435* (2013.01); *H01Q 9/0457* (2013.01); *H01Q 21/065* (2013.01); *H01Q 21/08* (2013.01); *H01Q 21/30* (2013.01)

(58) Field of Classification Search
CPC ..... H01Q 5/50; H01Q 5/307; H01Q 21/08; H01Q 9/0457; H01Q 9/0435; H01Q 9/0414
See application file for complete search history.

(56) References Cited

U.S. PATENT DOCUMENTS

| | | | | |
|---|---|---|---|---|
| 3,922,683 | A | 11/1975 | Kumpebeck | |
| 3,969,730 | A | 7/1976 | Fuchser | |
| 4,243,990 | A | 1/1981 | Nemit | |
| 4,623,894 | A | 11/1986 | Lee | |
| 4,827,271 | A | 5/1989 | Berneking | |
| 4,912,481 | A | 3/1990 | Mace | |
| 5,210,542 | A | 5/1993 | Pett | |
| 5,220,335 | A | 6/1993 | Huang | |
| 5,227,808 | A | 7/1993 | Davis | |
| 5,307,075 | A | 4/1994 | Huynh | |
| 5,394,163 | A | 2/1995 | Bullen | |
| 5,434,580 | A | 7/1995 | Raguenet et al. | |
| 5,497,164 | A | 3/1996 | Croq | |
| 5,512,914 | A | 4/1996 | Hadzoglou | |
| 5,537,367 | A | 7/1996 | Lockwood | |
| 5,757,324 | A | 5/1998 | Helms | |
| 5,767,814 | A | 6/1998 | Conroy | |
| 5,861,845 | A | 1/1999 | Lee | |
| 5,903,822 | A | 5/1999 | Sekine | |
| 5,969,689 | A | 10/1999 | Martek | |
| 6,025,812 | A | 2/2000 | Gabriel | |
| 6,046,706 | A | 4/2000 | Vargas | |
| 6,075,485 | A | 6/2000 | Lilly | |
| 6,091,365 | A | 7/2000 | Derneryd | |
| 6,118,406 | A | 9/2000 | Josypenko | |
| 6,133,882 | A | 10/2000 | LaFleur | |
| 6,147,648 | A | 11/2000 | Granholm | |
| 6,154,180 | A | 11/2000 | Padrick | |
| 6,175,333 | B1 | 1/2001 | Smith | |
| 6,211,824 | B1 | 4/2001 | Holden | |
| 6,211,841 | B1 | 4/2001 | Smith | |
| 6,239,762 | B1 | 5/2001 | Lier | |
| 6,307,519 | B1 | 10/2001 | Livingston | |
| 6,317,084 | B1 | 11/2001 | Chen | |
| 6,333,720 | B1 | 12/2001 | Gottl | |
| 6,362,790 | B1 | 3/2002 | Proctor, Jr. | |
| 6,377,217 | B1 | 4/2002 | Zhu | |
| 6,388,620 | B1 | 5/2002 | Bhattacharyya | |
| 6,421,024 | B1 | 7/2002 | Stolle | |
| 6,452,549 | B1 | 9/2002 | Lo | |
| 6,462,710 | B1 | 10/2002 | Carson | |
| 6,480,168 | B1 | 11/2002 | Lam | |
| 6,489,925 | B2 | 12/2002 | Thursby | |
| 6,525,691 | B2 | 2/2003 | Varadan | |
| 6,538,603 | B1 | 3/2003 | Chen | |
| 6,552,687 | B1 | 4/2003 | Rawnick | |
| 6,597,327 | B2 | 7/2003 | Kanamaluru | |
| 6,611,237 | B2 | 8/2003 | Smith | |
| 6,741,210 | B2 | 5/2004 | Brachat | |
| 6,762,719 | B2 | 7/2004 | Subotic | |
| 6,771,221 | B2 | 8/2004 | Rawnick | |
| 6,774,844 | B2 | 8/2004 | Subotic | |
| 6,819,300 | B2 | 11/2004 | Gottl | |
| 6,842,157 | B2 | 1/2005 | Phelan et al. | |
| 6,911,939 | B2 | 6/2005 | Carson | |
| 6,937,191 | B2 | 8/2005 | Puente Baliarda | |
| 6,943,732 | B2 | 9/2005 | Gottl | |
| 7,053,852 | B2 | 5/2006 | Timofeev | |
| 7,079,083 | B2 | 7/2006 | Gottl | |
| 7,196,674 | B2 | 3/2007 | Timofeev | |
| 7,382,329 | B2 | 6/2008 | Kim | |
| 7,868,843 | B2 | 1/2011 | Borau et al. | |
| 8,497,814 | B2 * | 7/2013 | Puente | H01Q 1/246 343/893 |
| 8,704,727 | B2 | 4/2014 | Cruz et al. | |
| 8,754,824 | B2 * | 6/2014 | Puente | H01Q 1/246 343/844 |
| 8,896,493 | B2 | 11/2014 | Baliarda et al. | |
| 9,450,305 | B2 * | 9/2016 | Puente | H01Q 1/246 |
| 10,211,519 | B2 * | 2/2019 | Puente | H01Q 1/246 |
| 2002/0140618 | A1 | 10/2002 | Plet et al. | |
| 2002/0171601 | A1 * | 11/2002 | Puente Baliarda | H01Q 1/246 343/893 |
| 2003/0011529 | A1 | 1/2003 | Gottl | |
| 2003/0137456 | A1 | 7/2003 | Sreenivas | |
| 2003/0184490 | A1 | 10/2003 | Raiman | |
| 2003/0189516 | A1 | 10/2003 | Olson | |
| 2004/0080457 | A1 | 4/2004 | Guo et al. | |
| 2004/0108956 | A1 | 6/2004 | Gottl | |
| 2004/0119645 | A1 | 6/2004 | Lee | |
| 2004/0145526 | A1 | 7/2004 | Puente Baliarda | |
| 2004/0155820 | A1 | 8/2004 | Sreenivas | |
| 2004/0155831 | A1 | 8/2004 | Goebel | |
| 2004/0201537 | A1 | 10/2004 | Stolle | |
| 2004/0201543 | A1 | 10/2004 | Gottl | |
| 2004/0203284 | A1 | 10/2004 | Stolle | |
| 2004/0227680 | A1 | 11/2004 | Wen et al. | |
| 2004/0233109 | A1 | 11/2004 | Ying et al. | |
| 2004/0257292 | A1 | 12/2004 | Wang | |
| 2004/0263392 | A1 | 12/2004 | Bisiules et al. | |
| 2005/0001778 | A1 | 1/2005 | Le | |
| 2005/0057417 | A1 | 3/2005 | Teillet | |
| 2005/0134512 | A1 | 6/2005 | Gottl | |
| 2005/0225498 | A1 | 10/2005 | Koparan | |
| 2005/0264463 | A1 | 12/2005 | Gottl | |
| 2006/0071870 | A1 | 4/2006 | Saito | |

(56) References Cited

U.S. PATENT DOCUMENTS

| | | | | |
|---|---|---|---|---|
| 2006/0114168 | A1 | 6/2006 | Gottl | |
| 2006/0176235 | A1 | 8/2006 | Gottl | |
| 2008/0062062 | A1* | 3/2008 | Borau | H01Q 1/246 343/844 |

FOREIGN PATENT DOCUMENTS

| | | |
|---|---|---|
| EP | 1071161 | 1/2001 |
| EP | 1168493 | 1/2002 |
| EP | 1227545 | 7/2002 |
| EP | 1320146 | 6/2003 |
| EP | 0843905 | 12/2004 |
| EP | 1223637 | 3/2005 |
| ES | 1058218 | 11/2004 |
| FR | 2704359 | 11/1994 |
| GB | 2161026 | 1/1986 |
| GB | 2424765 | 10/2006 |
| JP | 10-209749 | 8/1998 |
| WO | 9505012 | 2/1995 |
| WO | 9735360 | 11/1997 |
| WO | 9821779 | 5/1998 |
| WO | 9959223 | 11/1999 |
| WO | 0046872 | 8/2000 |
| WO | 0052787 | 9/2000 |
| WO | 0055939 | 9/2000 |
| WO | 0154225 | 7/2001 |
| WO | 0191233 | 11/2001 |
| WO | 02091518 | 11/2001 |
| WO | 0223669 | 3/2002 |
| WO | 02084790 | 10/2002 |
| WO | 02095874 | 11/2002 |
| WO | 02096166 | 11/2002 |
| WO | 03023900 | 3/2003 |
| WO | 03036759 | 5/2003 |
| WO | 03083992 | 10/2003 |
| WO | 2004010535 | 1/2004 |
| WO | 2004055938 | 7/2004 |
| WO | 2005055362 | 6/2005 |
| WO | 2005122331 | 12/2005 |
| WO | 2006024516 | 3/2006 |
| WO | 2007011295 | 1/2007 |

OTHER PUBLICATIONS

Armogida , A. ; Peixeiro , C., Microstrip patch antenna array for a mobile communication system base station, Antennas and Propagation Society (APS), 1997. IEEE International Symposium, Jul. 13, 1997, vol. 1.

Borja , C., Fractal microstrip patch antennas with fractal perimeter and self-affine properties, Universitat Politecnica de Catalunya (UPC), May 1, 2001.

Chan , T. ; Hwang , Y., A dual-band microstrip array antenna, Antennas and Propagation Society (APS), 1995. IEEE International Symposium, Jun. 18, 1995.

Chu , R. et al., Analysis and design of a multi-band phased array using multi-feed dipole elements, Antennas and Propagation Society (APS), 1995. IEEE International Symposium, Jun. 15, 1995.

Chu , R. et al., Multiband phased-array antenna with interleaved tapered-elements and waveguide radiators, Antennas and Propagation Society (APS), 1996. IEEE International Symposium, Jul. 21, 1996.

Gianvittorio , J. P., Fractal loop elements in phased array antennas—reduced mutual coupling and tighter packing, Phased Array Systems and Technology, 2000. IEEE International Conference on, Jan. 1, 2000.

Gianvittorio , J. P., Fractal elements in array antennas: investigating reduced mutual coupling and tighter packing, Antennas and Propagation Society (APS), 2000. IEEE International Symposium, Jul. 16, 2000.

Gray , D. ; Lu , J. W. ; Thiel , D. V., Electronically steerable Yagi-Uda microstrip patch antenna array, Antennas and Propagation, IEEE Transactions on, May 1, 1998, vol. 46.

Greiser , J. W. and Brown , G. S., A 500:1 scale model of warla : A wide aperture radio location array, USAF Antenna Research and Development Program, 13th , 1963. Symposium on the, Oct. 14, 1963.

Hienonen , S., Studies on microwave antennas: passive intermodulation distortion in antenna structures and design of microstrip antenna elements, Helsinki University of Technology, Mar. 1, 2005.

Izadian , J. S., Base-Station antennas. Offer dual polarization, Microwaves & RF, May 2, 2002.

Jones , H. S., Conformal and Small antenna designs, Proceedings of the Antennas Applications Symposium, Aug. 1, 1981.

Kim , H., Dual-feeding microstrip antenna with high isolation, Microwave and Optical Technology Letters, Oct. 5, 2002, vol. 35, No. 1.

Kim , Y. ; Jaggard , D. L., The fractal random array, Proceedings of the IEEE, Sep. 1, 1986.

Kim , Y. et al., A study of wideband dual-frequency dual-polarization microstrip array antenna, Antennas and Propagation Society (APS), 2000. IEEE International Symposium, Jul. 1, 2000, vol. 2, pp. 502-505.

Lindmark , B., Dual polarised multibeam antenna, Electronics Letters, Dec. 9, 1999, vol. 35, No. 25.

Lu , J. H., Broadband dual-frequency operation of circular patch antennas and arrays with a pair of L-shaped slots, Antennas and Wireless, IEEE Transactions on, May 1, 2003, vol. 51, No. 5.

Lu , J. H. ; Wong , K. L., Dual-frequency rectangular microstrip antenna with embedded spur lines and integrated reactive loading, Microwave and Optical Technology Letters, May 20, 1999, vol. 21.

Mayes , P. E., Frequency independent antennas and broadband derivatives thereof, Proceedings of the IEEE, Jan. 1, 1992.

Munson , R., Conformal microstrip array for a parabolic dish, USAF Antenna Research and Development Program, 23th , 1973. Symposium on the, Oct. 1, 1973.

Parker , E. A. ; El Sheikh , A. N. A., Convoluted array elements and reduced size unit cells for frequency selective surfaces, Microwaves, Antennas and Propagation, IEE Proceedings H, Feb. 1, 1991, pp. 19-22.

Poularikas , A., Handbook of antennas in wireless communications—Chapter 11—Outdoor and indoor cellular/personal handy phone system base station antenna in Japan, CRC, Jan. 1, 2002.

Puente , C., Fractal antennas, Universitat Politecnica de Catalunya (UPC), May 1, 1997.

Puente , C. ; Pous , R., Diseño fractal de agrupaciones de antenas—Fractal design of antenna arrays, Unión Cientifica Internacional de la Radio (URSI), 9th , La Palma, 1994. Simposium Nacional de la, Sep. 1, 1994.

Puente , C. ; Pous , R., Fractal design of multiband and low side-lobe arrays, Antennas and Propagation, IEEE Transactions on, May 1, 1996, vol. 44, No. 5.

Puente , C. ; Romeu , J. ; Cardama , A. ; Pous , R., Multiband fractal antennas and arrays, Fractals engineering—from theory to industrial applications, Jan. 1, 1997.

Ramirez , R. R. et al., A mutual coupling study of linear and circular polarized microstrip antennas for diversity wireless systems, Antennas and Propagation, IEEE Transactions on, Feb. 1, 2003.

Seo , C., A novel active array antenna using a transmission-line coupling, Microwave and Optical Technology Letters, May 5, 2001, vol. 29, No. 5, pp. 148-151.

Suarez , C. A. et al., Diseño del elemento básico en una agrupación circular para estaciones base GSM-UMTS, Unión Cientifica Internacional de la Radio (URSI), 21th , Oviedo, 2006. Simposium Nacional de la, Oct. 12, 2006.

Voipio , V., Triple band dual polarized basestation antenna, Antennas and Propagation Society (APS), 2007. IEEE International Symposium, May 1, 2007.

Voipio , V. et al., Dual band dual polarized basestation antenna FDTD design study, Antennas and Propagation Society (APS), 2007. IEEE International Symposium, Feb. 1, 2007.

Wong , K. L., Planar antennas for wireless communications, Wiley, Jan. 1, 2003, pp. 1-49.

Wong , K. L. ; Sze , J. Y., Dual-frequency slotted rectangular microstrip antenna, Electronics Letters, Jul. 9, 1998.

(56) References Cited

OTHER PUBLICATIONS

Jaggard , D. L., Expert report of Dwight L. Jaggard (redacted)—expert witness retained by Fractus, Fractus, Feb. 23, 2011.
Jaggard , D. L., Rebuttal expert report of Dr. Dwight L. Jaggard (redacted version), Fractus, Feb. 16, 2011.
Long , S., Rebuttal expert report of Dr. Stuart A. Long (redacted version), Fractus, Feb. 16, 2011.
Sportellini , E., PCT/IB2006/002975—International Search Report and Written Opinion, International Search Authority, dated Sep. 7, 2007.
Dinh , T. V., U.S. Appl. No. 12/089,751—Final Office Action dated Sep. 6, 2012, USPTO, dated Sep. 6, 2012.
Dinh , T., U.S. Appl. No. 12/089,751—Notice of Allowance dated Jul. 11, 2013, USPTO, dated Jul. 11, 2013.
Dinh , T. V., U.S. Appl. No. 12/089,751—Office Action dated Apr. 26, 2012, USPTO, dated Apr. 26, 2012.
Mithani , S., U.S. Appl. No. 12/089,751—Response to Final Office Action dated Sep. 6, 2012, Winstead, dated Feb. 21, 2013.
Mithani , S., U.S. Appl. No. 12/089,751—Response to Office Action dated Apr. 26, 2012, Winstead, dated Aug. 17, 2012.

* cited by examiner 100
100
100
104
102
103
101

SLIM TRIPLE BAND ANTENNA ARRAY FOR CELLULAR BASE STATIONS

CROSS REFERENCE TO RELATED APPLICATIONS

This patent application is a divisional application of U.S. patent application Ser. No. 15/232,160, filed on Aug. 9, 2016, which is a continuation application of U.S. patent application Ser. No. 14/282,488, filed on May 20, 2014, now U.S. Pat. No. 9,450,305, issued on Sep. 20, 2016, which is a continuation application of U.S. patent application Ser. No. 13/933,636, filed on Jul. 2, 2013, now U.S. Pat. No. 8,754,824, issued on Jun. 17, 2014, which is a continuation application of U.S. patent application Ser. No. 12/089,751, filed on Oct. 20, 2008, now U.S. Pat. No. 8,497,814, issued on Jul. 30, 2013, which is a national stage filing of International Patent Application No. PCT/IB2006/002975, filed on Oct. 12, 2006, which claims priority to European Application No. EP 05109585.9, filed on Oct. 14, 2005. International Patent Application No. PCT/IB2006/002975 claims priority from U.S. Provisional Patent Application No. 60/727,981, filed on Oct. 18, 2005. The entire contents of all of the priority documents are hereby incorporated by reference.

TECHNICAL FIELD

The present invention relates to an antenna array for cellular base stations, in particular to a slim triple-band antenna array.

The present invention refers to a slim triple-band antenna array for cellular base stations, which provides a reduced width of the base station antenna and minimizes the environmental and visual impact of a network of cellular base station antennas, in particular in mobile telephony and wireless service networks. The invention relates to a novel family of slim base station sites that are able to integrate multiple mobile/cellular services into a compact radiating system.

A triple-band antenna array according to the present invention comprises an interlaced arrangement of small radiating elements to significantly reduce the size of said antenna array. More specifically, in an embodiment the slim triple-band antenna array operates in a first frequency band, a second frequency band and a third frequency band, wherein the ratio between said first and second frequency bands is less than 1.58, or 1.48, or 1.38, or 1.28, or even 1.18, and wherein the ratio between said first band (or said second band) and said third band is more than 1.3, or 1.4, or 1.5, or 1.6, or even 1.7.

Another aspect of the invention relates to a method to reduce the environmental and visual impact of a base station able to integrate $1^{st}$, $2^{nd}$, and $3^{rd}$ generation communication services comprising the steps of integrating three triple-band antenna arrays in a slim cylinder of a three-sector triple-band base station. The invention also provides means for increasing the number and density of subscribers of mobile wireless and cellular services without increasing the number of base station sites, to increase the speed of deployment of 3G services on top of existing ones and to reduce the cost and investments of the resulting mobile service network.

BACKGROUND

The Universal Mobile Telecommunications System (UMTS), also known as the third generation of wireless communications systems, is currently being added to the $1^{st}$ and $2^{nd}$ generation of wireless communications systems (such as for instance GSM850, GSM900, DCS, PCS1900, CDMA, or TDMA) and has stimulated the demand for multiband antenna arrays and, in particular, for triple-band base station antenna arrays. Such triple-band antenna arrays integrate the $1^{st}$, $2^{nd}$, and $3^{rd}$ generation of wireless communications systems.

A typical cellular service requires a network of base stations, each of them comprising several base station antenna arrays, to provide coverage to the users of said cellular service. The antenna arrays are the radiating part of the base station. Usually, the radiating part of the base station is composed by nine or three independent antenna arrays that give service to, for example, a specific part of a city, a village, a road, or a motorway. Since the radiating part of the base station is composed by several antenna arrays, the dimensions of a conventional base station are large and the resulting base station has a significantly big visual impact One possibility to enable a base station to provide coverage for three different mobile communication systems is to use for example three single-band antenna arrays (for example one for GSM900, another for DCS and a third one for UMTS). Since typical base stations split their area of coverage into three different sectors, three single band antenna arrays are required for each of said sectors, which means that the triple-band three-sector base station might require up to a total of nine antenna arrays. As an alternative, and in order to reduce the antenna array count for the base station, two out of the three operation bands could be combined in a dual-band antenna array (such as for instance DCS and UMTS). In this case only two antenna arrays would be necessary in each sector, resulting in a total of six antenna arrays for a triple-band three-sector base station. The use of multiple single-band antenna arrays (or a combination of single-band and dual-band antenna arrays) in a triple-band base station will typically lead to bulky and mechanically complex structures, hardly disguisable with the surrounding environment. Furthermore, a large antenna array count will likely result in a costly solution.

As an alternative, some conventional triple-band antenna arrays that are used today for base stations make use of a side-by-side configuration, in which three single-band antenna arrays are arranged one next to another along the direction defined by the width of the single-band antenna arrays and packed in a single dielectric enclosure or radome.

Although, this approach reduces the number of antenna arrays in the base station to just three (i.e., one per sector), it still performs poorly in terms of minimizing the visual impact of the base station, as the dimensions of these antenna arrays, specially their width, are significantly larger than the dimensions of a single-band antenna array.

Nowadays, local, regional and/or national governments and public administrations are concerned about the visual impact of the base stations in their cities, mainly because of the large size of the antenna arrays. As governments and public administrations endeavor in minimizing the visual impact of the base station of cellular communications networks, it is becoming more and more difficult for network operators and mobile service providers to acquire new sites and/or obtain the license to set up new base stations in cities and villages around the world.

The visual impact due to the size and number of antenna arrays in a base station has been a rising issue for network operators and consumers, creating the demand for smaller-sized antenna arrays for base stations, with which to reduce substantially the visual impact of the base station but without compromising the level of performance and functionality of current solutions.

Adjustable electrical down-tilt techniques for antenna array systems are very well known in the related background art.

SUMMARY

The above mentioned drawbacks are overcome with a triple-band antenna array with a slim triple-band base station and with a method to couple capacitively an electrical signal to a radiating element, and with a method to reduce the environmental and visual impact of a network of cellular or wireless base stations.

The invention provides devices and means to minimize the visual impact and cost of mobile telecommunication networks while at the same time simplifying the logistics of the deployment, installation and maintenance of such networks. The invention provides a slim triple-band base station, which integrates multiple mobile/cellular services into a compact radiating system (or radiating part). Such a base station could advantageously integrate the $1^{st}$, $2^{nd}$, and $3^{rd}$ generation of mobile and wireless communications services, increasing the number of cellular users that can communicate with a given base station, and hence increasing the capability of the network for a given (i.e., fixed) network of base stations, or alternatively reducing the number of base stations required in the network for a fixed capacity. The radiating system optionally includes an adjustable electrical tilt mechanism for one or more of the operating frequency bands, thus providing additional flexibility when planning, adjusting, and optimizing the coverage, and increasing the capacity of the network. Also, the slim form factor of the radiating system as described by the present invention enables slimmer (i.e., smaller diameter) and lighter-weight towers to support such radiating systems, which are easier to carry, for example, to the roof of a building (for instance through elevators, through staircases, or with small lift systems) where the radiating systems might be installed.

In some cases, the slim triple-band antenna array operates in a first frequency band, a second frequency band, and a third frequency band, wherein said first and second frequency bands are within a first range of frequencies; and wherein said third frequency band is within a second range of frequencies. In some embodiments, said first range of frequencies preferably refers to the range of frequencies from approximately 1,700 MHz to approximately 2,170 MHz, including any subinterval within that range; and said second range of frequencies preferably refers to the range of frequencies from approximately 700 MHz to approximately 1,000 MHz, including any subinterval within that range. In some examples according to the present invention, the ratio between the first or second frequency band with the third frequency band is larger than 1.3, or 1.4, or 1.5, or 1.6, or even 1.7. Moreover, the ratio between the first and the second frequency bands is less than 1.58, or 1.48, or 1.38, or 1.28, or even 1.18. In the context of this document, the ratio between two frequency bands is computed from the ratio between the central frequencies of each of said two frequency bands, dividing the highest central frequency by the lowest central frequency. For instance, in the case of a first frequency band in the 1,920 MHz-2,170 MHz interval (e.g., to service UMTS) and a second frequency band in the 1,710 MHz-1,880 MHz interval (e.g., to service GSM1800) the ratio between bands is computed as the central frequency of the first frequency band f1=2,045 MHz and the central frequency of the second frequency band f2=1,795 MHz. In this example f1/f2=1.139, therefore the ratio between the two frequency bands is 1.139 which is, for example, smaller than 1.18.

The first and second frequency bands of the slim triple-band antenna might in certain embodiments include each two, three or more cellular or wireless services. In one example of the present invention, and without limiting purposes, the first frequency band could provide the GSM1800, PCS, and UMTS services (i.e., three services), the second frequency band could operate the GSM1800 and UMTS services (i.e., two services) and the third frequency band could provide the GSM850 and/or GSM900 service. In another example, the first and second frequency bands could operate each the GSM1800, PCS, and UMTS services. In some embodiments the first and second frequency bands are different, while in some other embodiments said first and second frequency bands are substantially equal.

In addition, the present invention makes it possible to integrate three triple-band antenna arrays in a slim cylinder due to the use of compact radiating elements and a compact ground plane. A slim triple-band antenna array according to the present invention comprises a first set of radiating elements able to operate in a first frequency band within a first range of frequencies; a second set of radiating elements able to operate in a second frequency band within the same said first range of frequencies; and a group of radiating elements able to operate in said first frequency band and/or said second frequency band, and also in a third frequency band within a second range of frequencies; said group of radiating elements comprising a first subset of radiating elements (hereinafter referred to as the third set) and a second subset of radiating elements (hereinafter referred to as the fourth set). In some examples, the radiating elements of said first set and said second set are preferably smaller than 0.5, 0.45, 0.4, 0.35, or even 0.3 times the wavelength at the highest frequency of operation of said radiating elements within said first range of frequencies. Similarly, in certain cases, the radiating elements of said third set and said fourth set are preferably smaller than 0.5, 0.45, 0.4, 0.35, or even 0.3 times the wavelength at the highest frequency of operation of said radiating elements within said second range of frequencies. Several techniques are possible to reduce the size of the radiating elements within the present invention, such as for instance using space-filling structures, multilevel structures, box-counting and/or grid dimension curves, and/or dielectric loading techniques.

Yet another aspect of the present invention is related to the arrangement of the radiating elements of the first set, the second set, the third set and the fourth set of radiating elements that form the slim triple-band antenna array. In an example, in order to further reduce the size of the triple-band antenna array, the radiating elements are disposed forming an interlaced topology. Interlaced topology preferably refers to an arrangement of radiating elements in which at least one radiating element of a given set of radiating elements is not adjacent to another radiating element of the same set of radiating elements. The radiating elements of the first set together with those of the third set provide a first frequency band of the antenna array, while the radiating elements of the second set together with a those of the fourth set provide a second frequency band of the antenna array. Finally, the radiating elements of said group comprising the third set and the fourth set provide a third frequency band of the array. In some cases, some radiating elements of said group of radiating elements can be in both said third set and said fourth set. Moreover, in some other cases said third set or said fourth set might not comprise any radiating element.

In a preferred embodiment of the present invention, a triple-band antenna array comprises a first set of radiating elements (101) operating at a first frequency band, a second set of radiating elements operating a second frequency band (102), a third set of radiating elements (103) operating at a third frequency band and also at said first frequency band, and a fourth set of radiating elements (104) operating at said third frequency band and also at said second frequency band.

In some cases, said first and second frequency bands will be preferably within the range from approximately 1,700 MHz to approximately 2,170 MHz (with any subinterval included). Moreover, in certain examples said third frequency band will be preferably within the range from approximately 700 MHz to approximately 1,000 MHz (with any subinterval included).

The combination of a first set of radiating elements (101) with the third set of radiating elements (103) provides a first frequency band of the antenna array (100). Then, the combination of a second set of radiating elements (102) with the fourth set of radiating elements (104) provides a second frequency band of the antenna array (100). Finally, the combination of the third set of radiating elements (103) with the fourth set of radiating elements (104) provides a third frequency band of the antenna array (100).

In some cases, some radiating elements of the antenna array (100) can be in both said third set (103) and said fourth set (104). Moreover, in some other cases said third set (103) or said fourth set (104) might not comprise any radiating element.

In certain cases, the radiating elements of said third set (103) and said fourth set (104) are preferably smaller than 0.5, 0.45, 0.4, 0.35, or even 0.3 times the wavelength at the highest frequency of operation of said radiating elements within said second range of frequencies.

In some examples, the radiating elements of the antenna array (100) are arranged in such a way that they are substantially aligned with respect to a vertical axis. The vertical separation between two adjacent radiating elements is preferably smaller than one wavelength at the highest frequency of operation of the antenna array. In some cases, such a vertical spacing can be even smaller than 0.9 or 0.8 times the wavelength at the highest frequency of operation of the antenna array. The vertical spacing between elements can be advantageously selected to control the gain of the antenna array in a particular band. In some embodiments, the vertical spacing between adjacent radiating elements is constant throughout the antenna array, while in other embodiments such spacing can be different for different pairs of radiating elements.

In certain examples of a triple-band antenna array (100), at least some of its radiating elements are displaced off the central vertical axis of the antenna array (100), so that there are radiating elements located on one or two sides of the antenna array (100).

In some other examples, the radiating elements of the array (100) are arranged in such a way that there is at least an element of the first set (101) and/or of the second set (102) shifted to the left side of the array (100), and at least another element of said first set (101) and/or of the said second set (102) shifted to the right side of the array (100).

Moreover, some radiating elements can be arranged side by side at the same vertical location but with a horizontal spacing. In some cases (see for example FIG. 1*c*) the radiating elements arranged side-by-side will belong to the same set of radiating elements, while in other cases (see examples in FIGS. 1*d* through 1*j*) the radiating elements arranged side-by-side will belong to different sets of radiating elements of the array (100). In some examples of the present invention, the radiating elements of the third set (103) and those of the fourth set (104) will preferably remain on the central vertical axis of the antenna array (100), and will not be displaced away from the said axis.

Moving at least some radiating elements off the central vertical axis of the antenna array can be advantageous to:

- Shape the horizontal beamwidth of the antenna array at some particular frequency band, to increase the directivity of the antenna array or to correct for asymmetries in the radiation pattern of the antenna array.
- Decrease the height of the antenna array in order to facilitate the integration of the antenna array in the structure of a base station.

In some embodiments, the horizontal spacing between side-by-side radiating elements is preferably smaller than one wavelength at the highest frequency of operation of the antenna array, and can be even smaller than 0.9 or 0.8 times the wavelength at the highest frequency of operation of the antenna array.

In some embodiments (such as for instance in FIGS. 1*e*, 1*g*, 1*h*, and 1*j*) there is at least one pair of adjacent vertically spaced radiating elements that belong to the same set of radiating elements. Such an arrangement can be advantageous to increase the gain, or to shape the vertical radiation pattern of the antenna array in at least one of its frequency bands.

The number of radiating elements in each one of the said first, second, third and fourth sets (101, 102, 103, 104) does not need to be the same, and it will be different for at least two of said sets of radiating elements in some examples of the present invention (see for example FIGS. 1*c* through 1*j*). Different number of elements will be preferably used in those cases where a different radiation pattern for each operating band is desired.

The radiating elements of the first set (101) and/or those in the second set (102) operate at a frequency band, which is preferably within the range of frequencies from approximately 1,700 MHz to approximately 2,170 MHz, and for two orthogonal polarizations. In some preferred embodiments, said radiating elements are patch antennas (as in FIG. 2), although other type of antenna topologies could also be used to implement the radiating element. The size of the radiating element (200, 230, 260) is less than 0.5 times the wavelength at the highest frequency of operation of said radiating elements.

The height of the radiating elements (200, 230, 260) with respect to the ground plane of the antenna array (201, 231, 261) is also small, helping in the integration of the triple band antenna arrays in a slim cylinder. The height is typically smaller than 0.15 times the wavelength (0.15λ), but also smaller than 0.08 times the wavelength (0.08λ) in several embodiments. Such a reduced height of the radiating elements (200, 230, 260) is possible due to the feeding technique used to excite the radiating elements.

In certain embodiments, the radiating elements are fed at four feeding points (203, 233). Two of the four feeding points (203, 233) are for a given polarization, and the other two feeding points for another polarization substantially orthogonal to the previous one. The two feeding points corresponding to a same polarization are combined by means of a divider, so that the resulting radiating element presents two feeding ports.

The four feeding points (203, 233) can excite the radiating element (200, 230) for instance by direct contact or through capacitive coupling. Capacitive coupling can be advantageous in some embodiments because no electrical contact is required to drive the radiating element, avoiding the need for solder joints or metal fasteners. This aspect can be interesting to reduce passive inter-modulation, and is one of the preferred embodiments of the invention.

Capacitive coupling can be obtained by means of a proximity region between the radiating element and a transmission line or a conductive part that carries an electrical signal. In some cases, such proximity region is closer to the radiating element than to the ground plane, while in other cases such proximity region will be closer to the ground plane than to the radiating element. In an example shown in FIG. 20, a conductive elongated element (2002), such as for instance a cylinder or prism, is placed vertically between the radiating element (2000) and the ground plane (2001), wherein the top surface of said element (2002) is connected to the radiating element (2000) and the bottom surface of said cylinder or prism (2002) is not in contact with a feeding transmission line (2003) arranged substantially close and parallel to the ground plane (2001). The radiating element (2000) is suspended over the ground plane (2001) by means of a dielectric spacer (2005), which could be a plastic holder in some examples. Said transmission line (2003) ends at a polygonal pad (2004) (such as for example, but not limited to, a square or a circle). The feeding transmission line (2003) and the polygonal pad (2004) could be made as a conductive layer printed on a dielectric substrate or backing. A coupling region is created between the bottom surface of said cylinder or prism (2002) and the polygonal pad (2004). In some embodiments, said polygonal pad (2004) is placed on the projection of said conductive elongated element (2002), so that the projection of said conductive elongated element (2002) is completely within the extension of said polygonal pad (2004). In some embodiments, at least a 60%, a 70%, an 80%, or even a 90% of the projection of said conductive elongated element (2002) is within the extension of said polygonal pad (2004). The diameter (D) of said cylinder or prism (2002) is preferably less than 2 mm, 3 mm, 4 mm, 5 mm, 6 mm, 8 mm or even 10 mm in some examples. Moreover, in some embodiments the height (g) of said coupling region is advantageously less than 1,000 microns, but it can also be less than 500 microns, 400 microns, 300 microns, 200 microns or even 100 microns. In some cases, the diameter of the polygonal pad (2004) is approximately equal to, or larger than, the diameter (D) of the cylinder or prism (2002).

In some embodiments, said coupling region will be filled with a low loss RF dielectric material (such as for instance Teflon or polypropylene) to minimize RF losses and maximize the power handling capabilities of the radiating element (2000). Coupling a feeding signal between the polygonal pad (2004) and the bottom surface of the said cylinder or prism (2002) can be advantageously made through a dielectric to optimize passive intermodulation performance, However, in other embodiments the dielectric in said coupling region will be air.

The radiating elements of the third set (103) and those in the fourth set (104) can operate at a first frequency band, which is preferably within the range of frequencies from approximately 1,700 MHz to approximately 2,170 MHz, and that can also operate at a second frequency band, which is preferably within the range of frequencies from approximately 700 MHz to approximately 1,000 MHz. Said radiating elements (300, 400, 420, 440, 460) comprise a first portion (301, 401, 421, 441, 461) which is mainly responsible for the operation in said first frequency band, and a second portion (302, 402, 422, 442, 462) which is mainly responsible for the operation in said second frequency band.

In the context of the radiating element, the first and the second frequency bands indicate that the radiating elements of the third set (103) and those of the fourth set (104) are able to operate in two different bands. These first and second frequency bands of operation of the radiating elements are not to be confused with the first and second frequency bands of operation of the antenna array.

In some embodiments, said first portion (301, 401, 441, 461) preferably comprises a parasitic element.

In some examples, the first portion of the radiating element (301, 401, 441, 461) is advantageously mounted on top or stacked on top of the second portion of the radiating element (302, 402, 442, 462).

The radiating elements of the third set (103) and those of the fourth set (104) have reduced dimensions. The size of the first portion (301) is less than half wavelength at the highest frequency of the first frequency band. Similarly, the size of the second portion (302) is less than half wavelength at the highest frequency of the second frequency band. The height of the radiating element (300) with respect to the ground plane of the antenna (303) is also small, typically smaller than 0.2 times the wavelength at the highest frequency of the second frequency band, facilitating the integration of the triple-band antenna arrays in a slim cylinder. In some examples, the height of the second portion (302) with respect to the ground plane (303) is typically smaller than 0.15 times, or even 0.08 times, the wavelength at the highest frequency of the second frequency band. Furthermore, the height of the first portion (301) with respect to the second portion (302) is typically smaller than 0.15 times the wavelength (0.15λ), but also smaller than 0.08 times the wavelength (0.08λ) at the highest frequency of the first frequency band in several embodiments.

In other embodiments, the first portion of the radiating element (421) is advantageously embedded within the second portion of the radiating element (422).

Said second portion (422) presents an aperture or opening (424) within its extent to allow embedding said first portion (421). The dimensions of said aperture or opening (424) will be preferably larger than a half of the wavelength at the highest frequency of the first frequency band (and in some examples even larger than 0.7 times, 0.65 times, 0.6 times or 0.55 times the said wavelength).

By embedding the first portion of the radiating element (421) within the second portion of said radiating element (422), the height of the radiating element (420) can be much less than 0.2 times the wavelength (such as 0.15 times or even 0.08 times) at the highest frequency of the second frequency band. Moreover, the first portion of the radiating element (421) does not need to be at the same height with respect to the ground plane (423) as the second portion (422).

In some cases, for low cost manufacturability and for consistent performance repeatability, the radiating elements (200, 230, 260, 300, 400, 420, 440, 460) can be produced by means of a process involving the steps of casting. Furthermore, the element support or spacer that holds the radiating elements at a distance from the ground plane, for example (2005) in FIG. 20, can be produced by means of a process comprising the steps of injection molding, again for the reasons of low cost manufacturability and consistent performance repeatability. For higher flexibility during the product design and development phases, said radiating elements (200, 230, 260, 300, 400, 420, 440, 460) can be easily made in some cases from simple machined parts. This is particularly interesting for prototyping and/or the production of limited series. In some other cases in can be advantageous to use modular radiating elements to accelerate the product design and development phases (for example to optimize the geometry of the radiating element), wherein a new iteration of radiating elements can be obtained by simply replacing and/or modifying a reduced number of modules in said radiating elements.

The second portion of the radiating elements of the third set (103) and those of the fourth set (104) may advantageously comprise indentations or gaps to tailor the radiation properties of said radiating elements.

A radiating element of the third set (103) or the fourth set (104) may comprise one, two, three, four or more indentations (444) in its second portion (442). In some examples, said indentations (444) are equal, while in others said indentations (444) have different shapes and/or dimensions. In some cases, the indentations (444) are preferably triangular.

The width (W) of the indentations (444) at the perimeter of the second portion of the radiating element (442) is preferably larger than 0.15 times the wavelength at the highest frequency of the second frequency band of the radiating element (440). The depth (d) of the indentations (444) is larger than 0.03 times said wavelength in some preferred embodiments.

A radiating element of the third set (103) or the fourth set (104) may comprise one, two, three, four or more gaps (464) in its second portion (462). In some examples, all the gaps (464) are equal, while in others said gaps (464) have different shapes and/or dimensions.

In some examples, the gaps (464) span an annular sector from approximately 40 degrees to approximately 90 degrees (including any subinterval within that range). Said gaps (464) are preferably located substantially close to the perimeter of the second portion of the radiating element (462). Some preferred maximum distances to the perimeter of said second portion (462) include 3 mm, 5 mm, 7 mm, and 10 mm. The width of the gaps (464) is advantageously selected to be not larger than 3 mm, 5 mm, 7 mm, or 10 mm in some embodiments. However, said width does not need to be constant throughout the extent of the gaps (464), nor does the distance of the gaps (464) to the perimeter of the second portion (462) need to be constant.

Once again, the radiating element (300, 400, 420, 440, 460) can be excited by means of direct contact or through capacitive coupling.

In an example, conductive posts or pins (304) deliver the electrical signal to the feeding points of the first portion of the radiating element (301). Said posts or pins (304) pass through the second portion of the element (302) by means of gaps (306) practiced in the extent of the second portion of the radiating element (302).

In some examples, the gaps (306) are substantially circular and have a preferred diameter of less than 2 mm, 3 mm, 5 mm, 7 mm, or even 9 mm. Such gaps (306) allow the posts or pins (304) pass through the second portion (302) avoiding undesired coupling of the electrical signal carried by the said posts or pins (304) with said second portion (302). Additionally, the conductive posts or pins (305) deliver another electrical signal to the feeding points of the second portion of the radiating element (302).

In order to enhance the manufacturability and/or improve the passive intermodulation performance of the antenna array, one or more of the following techniques can be used in the design of the structure of the radiating element:

- Avoidance of metal-to-metal contacts between the radiating element and the feeding network, such as for example using capacitive coupling to excite said element.
- Avoidance of direct mechanical fasteners between the radiating element and the feeding network.
- Placement of any mechanical fastener between the radiating element and the ground plane of the antenna array substantially close to a region of the said radiating element in which the current density distribution is low. In some embodiments, such a region will be preferably close to the center of the radiating element.

In some examples, since the feeding points of the radiating element (200, 230, 260, 300, 400, 420, 440, 460) are located substantially close to the periphery of said element (200, 230, 260, 300, 400, 420, 440, 460), said feeding points can also be used to provide mechanical support to the radiating element (200, 230, 260, 300, 400, 420, 440, 460). Such a feature can be achieved optionally in combination with a single fastener at the center of the radiating element.

In some instances of the present invention, the second portion of the radiating element (302, 402, 422, 442, 462) can be electromagnetically coupled (either by direct contact, or by means of capacitive or inductive coupling) to the ground plane of the antenna (303, 403, 423, 443, 463) in at least one, two, three or more points throughout the extent of said second portion (302, 402, 422, 442, 462). Such a technique can be advantageous to finely modify the radiation properties of the radiating element (300, 400, 420, 440, 460). In particular, this technique combined with the feeding mechanism of the radiating element (300, 400, 420, 440, 460) can be useful to improve the coupling between the first and the second operating bands of said elements (300, 400. 420, 440, 460).

When combining radiating elements of a stacked architecture (such as for instance those in FIG. 3, 4*a*, 4*c*, or 4*d*) with other non-stacked radiating elements (such as those in FIG. 2*a*, 2*b*, or 2*c*) to obtain one of the operating bands of the triple-band antenna array, the larger height of the stacked elements (300, 400, 440, 460) may result in phase errors in the phase progression applied to the elements in the antenna array. This problem can be corrected by means of including an additional phase in the excitation of the radiating elements of lower height (i.e., the non-stacked radiating elements), such as for example adding an extra length of cable or transmission line in the feeding network of the radiating elements of the antenna array.

Several features (such as metal walls forming an enclosure around radiating elements, conductive posts placed between radiating elements, or flanges placed at the edges of the ground plane of the antenna array) are included in some embodiments to improve isolation between polarizations, coupling between operating bands, horizontal pattern shape and/or cross-polarization level.

In some preferred embodiments (for instance the example in FIG. 5*c*) at least some of the radiating elements (500) of the antenna array are surrounded by metal walls (or flanges) forming an enclosure (540) around said radiating element (500). The height of the walls of the enclosure (540) with respect to the ground plane (503) can possibly be at least 0.12 times, 0.105 times, 0.09 times, 0.075 times, 0.06 times, 0.045 times, or 0.03 times the wavelength of the highest frequency of the lowest band of operation of the antenna array. In some embodiments, the lateral walls of the enclosure (540) can have different height, or the height might not be constant. In some cases, the enclosure (540) might be open, that is some lateral wall is missing so that the radiating element (500) is not completely surrounded by the said enclosure (540). Said enclosure (540) does not need to have a square shape, and its transversal dimensions can be selected from the range from approximately 0.25 times to approximately 0.45 times the wavelength of the highest frequency of the lowest band of operation of the antenna array.

Some other preferred embodiments of the antenna array comprise one or several conductive posts (560) placed between some radiating elements of the antenna array (e.g., embodiment in FIG. 5*d*). In some embodiments, the posts (560) will be electromagnetically coupled with the ground plane (503), for example by direct contact. The number of post (560) can vary from some embodiments to others, although preferably there is at least one post at either side of the radiating element (500). The posts (560) can be arranged substantially along the central axis of the array (i.e., along the direction on which the radiating elements are arranged), or alternatively be placed off said axis, or as a combination thereof. The height of the posts (560) referred to the ground plane (503) can advantageously be less than 0.165 times the wavelength of the highest frequency of the lowest band of operation of the antenna array, and possibly also less than 0.15 times, 0.135 times or even 0.12 times said wavelength. Additionally, the posts (560) do not have all the same height in some embodiments.

In another example of the antenna array, flanges (602, 652) are placed at the edges of the ground plane (601), and tilted upwards with respect to said ground plane (601). The length (L) of the flanges (602, 652) is in some cases less than 0.15 times the wavelength of the highest frequency of the lowest band of operation of the antenna array, and possible also less than 0.135 times, 0.12 times, 0.105 times, or 0.09 times said wavelength. The flanges (602, 652) can comprise slots, gaps or openings, or be made of conducting stripes.

Due to the simple shape of the ground plane, said ground plane can be manufactured in some embodiments by means of a process comprising the steps of extruded processes and/or sheet metal processes, and using lightweight materials such as for example aluminum.

In some embodiments of this invention the slim triple-band base station includes a triple-band dual polarized antenna array with variable down-tilt for at least one of the bands of operation. In some cases, two bands or even the three bands of operation will have the feature of variable down-tilt. Furthermore, in some cases the variable down-tilt will be independent for each one of the bands of operation of the antenna array, while in other cases it can be common to at least two of the three frequency bands. Having a common variable down-tilt mechanism for more than one band can be advantageous in reducing the complexity of the antenna array. On the other hand, independent variable down-tilt for each frequency band provides more flexibility to network operators when using an antenna array according to the present invention.

Variable down-tilt can be achieved by means of a phase shifter and adequate vertical spacing of the radiating elements.

In some examples, a slim triple band antenna array comprises a phase shifting device (or phase shifter) providing an adjustable electrical down-tilt for each frequency band. The phase shifter includes an electrical path of variable length to change the relative phases of the radiating elements of the antenna array, which will introduce a down-tilt in the direction of maximum radiation of the antenna array.

The electrical length of the phase shifter may be adjusted either manually or by means of a small electric motor (not shown in the figures), which in turn may be remotely controlled by means of any technique known in the prior art.

In some embodiments said vertical spacing is less than a wavelength, but also preferably less than ¾ of the wavelength (¾λ) and less than ⅔ the wavelength (⅔λ) at all frequencies of operation to maintain a good radiation pattern. Such spacing is specified, for instance, taking into consideration the center of the radiating elements. The center of the radiating element can be preferably determined by the center of the smallest circumference in which the radiating element can be inscribed.

The disclosed invention allows the integration of three triple-band antenna arrays in a slim cylinder because of, for instance, the compact phase-shifter that enables variable electrical down-tilt, being in some cases the said down-tilt independent for each of the three operating bands of the triple-band antenna array. The thickness of phase shifter is advantageously less than 0.07 times the wavelength (0.07λ).

The invention therefore provides as well a method for reducing the size of the radiating part of a base station, and therefore a method for minimizing the environmental and visual impact of a network of cellular base station antennas, in particular in mobile telephony and wireless service networks. The invention also provides the means for integrating in a base station of reduced visual impact all cellular and wireless services corresponding to the $1^{st}$, $2^{nd}$, and $3^{rd}$ generations (1G, 2G, 3G), or even future 4G services, reducing the cost of the base stations, and the cost associated to their installation, while at the same time accelerating the deployment of the network.

One aspect of the present invention relates to a slim triple-band antenna array using compact antenna and compact phase shifter technology to allow the integration of three triple-band antennas on a slim cylinder, which results in a triple-band three-sector base station with a reduced size and visual impact if compared to the radiating part of current base stations. More specifically, the diameter of a slim base station comprising in its radiating part this new slim antenna array is typically less than 1.5 times the wavelength of the highest frequency of the lowest band of operation of the antenna, and in some cases such a diameter is even less than 1.4, 1.3, or 1.2 times the said wavelength, which is significantly smaller than the size of the radiating part of conventional base stations carrying GSM900 antennas.

One of the main advantages of the present invention is that it is possible to integrate three triple-band antenna arrays in a slim cylinder, forming a three-sector base station. The three antenna arrays can be fitted inside a single cylinder radome. In the case of the triple-band antenna array of the present invention, the diameter of the circumference of the slim cylinder in which the three antenna arrays can be fitted is less than 1.75 times, or 1.65 times, or 1.60 times, or 1.55 times, or even 1.45 times the wavelength at the highest frequency of the lowest operating band of said antenna arrays. Such a small diameter can be achieved because of the compact size and the architecture of each of the triple-band antenna arrays. In order to shrink the diameter of a three-sector slim triple-band base station even further, small-sized radiating elements with smaller ground plane are used in some embodiments arranged in an interlaced configuration according to the present invention.

Another aspect of the invention is that the transversal dimensions (i.e., width and thickness) of the antenna array are small compared to those of typical triple-band base station antenna arrays. In the context of this application, the width of an antenna array preferably refers to the dimension along an axis contained in the plane defined by the ground plane of the antenna array, being said axis substantially perpendicular to the direction along which the radiating elements of the antenna array are disposed. Similarly in the context of this document, the thickness of the antenna array preferably refers to the dimension along an axis substantially perpendicular to plane defined by the ground plane of the antenna array. Particularly, in some embodiments the width of the antenna array is less than two times the wavelength (2λ), such as for instance one and half times the wavelength (1.5λ), 1.4 times the wavelength (1.4λ), 1.3 times the wavelength (1.3λ), or even in some cases less than one wavelength (1λ) for the highest frequency of the lowest operating band. In some examples, the thickness of an antenna array according to the present invention is preferably less than half wavelength (0.5λ), such as for instance 0.4 times the wavelength (0.4λ) and even in some embodiments less than 0.3 times the wavelength (0.3λ) for the highest frequency of the lowest frequency band. Despite the narrow width and thickness of the antenna array, the radiation pattern characteristics (such as for instance the vertical and horizontal beamwidth, and the upper side-lobe suppression) are maintained.

In a preferred embodiment said antenna arrays are radially spaced from the central axis of a slim cylinder in which the antenna arrays can be fitted. Each antenna array is longitudinally (i.e., along the direction of the said central axis) placed within an angular sector defined around said central axis.

As shown in FIG. 10, the antenna arrays (1001, 1001', 1001") are radially spaced from a central axis (1003) of the slim base station structure. Each antenna array (1001, 1001', 1001") is respectively placed longitudinally within an angular sector (1002, 1002', 1002") defined around said central axis (1003), the antenna arrays (1001, 1001', 1001") being substantially parallel to said central axis (1003). The three antenna arrays (1001, 1001', 1001") are housed within a substantially cylindrical radome (1000), which is preferably made of dielectric material (such as for example, but not limited to, fiberglass compounds) and is substantially transparent within the 700 MHz-1,000 MHz and 1,700-2,170 MHz frequency ranges. As shown in FIG. 10, each array is placed according to the position of the sides of an equilateral triangle, whose center is the axis (1003) of the slim base station structure. A central support inside the cylindrical radome (not shown) is aligned with respect said axis (1003), and the antenna arrays (1001, 1001', 1001") are mounted on said central support at a selected distance.

In some examples, the number of antenna arrays around the central support will be just two, while in some other embodiments this number will be larger than three, preferably four, five, or six.

In some embodiments, an angular spacing is introduced between antenna arrays, and a mechanical feature is added in order to steer the horizontal boresight direction of the antenna array independently in each sector, optimizing in this way the azimuth coverage within each sector. In this particular case, the diameter of the total circumference formed by the three antenna arrays is still less than 1.75 times, or 1.70 times, or 1.65 times, or even 1.60 times the wavelength at the highest frequency of the lower frequency band, with an angular spacing of at least approximately 20 degrees. Smaller diameter is achieved in certain embodiments by reducing the angular spacing and/or its adjustment range.

In some examples, a triple-band antenna array according to the present invention may further comprise a mechanical feature to steer the horizontal boresight direction from approximately 0 degrees to approximately 30 degrees independently for each of the antenna arrays integrated in a triple-band three-sector base station.

For any given slim three-sector triple-band base station, there is always a compromise between the following aspects:

- Having the smallest radome diameter for lower visual impact and lower wind load, and allowing for better camouflaging of the radiating part of the base station with the environment;
- Having the biggest angular spacing for higher degree of flexibility in optimizing the azimuth coverage in each sector;
- Having the maximum horizontal radiation aperture to increase the directivity of the antenna array in the horizontal plane.

As the height of the antenna array can be in some cases up to nine times the wavelength at the highest frequency of the lowest operating band of the antenna array, twisting or mechanical distortion of the shape of the ground plane can compromise the planarity, or even the integrity, of the said ground plane. In some embodiments, to strengthen the mechanical structure of the antenna array, the ground plane of the antenna array has flanges bent downwards (i.e., away from the radiating elements). In these cases, the angle of bending will be preferably larger than 90 degrees, but also possibly larger than 110 degrees, or even larger than 130 degrees in order to strengthen the mechanical structure of the antenna array while maximizing the angular spacing between sectors, in a multi-sector configuration, for enhanced flexibility in azimuth.

In some embodiments, a preferred angle (a) that achieves the best compromise is equal to:

$$\alpha=30°+A/2$$

wherein (α) is the angle between the horizontal and the flanges of the ground plane and (A) is the angular spacing between 2 antenna arrays.

Also, such slim radiating systems make it possible for the resulting base station to be implemented as lighter-weight and portable towers, which can be constructed by stacking or assembling modular building sections. Such a modular structure can be advantageously used to introduce folding, bending, retracting and/or hoisting mechanisms for an easier installation, and servicing of the antenna arrays, the electronic systems and/or the electromechanical systems integrated in the structure of the slim triple-band base station. Also, the slim triple-band base station can be easily disguised in the form of other urban architectural elements (such as for instance, but not limited to, street light poles, chimneys, flag posts, advertisement posts and so on) while at the same time integrating other equipment (such as filters, diplexers, tower mounted low-noise amplifiers and/or power amplifiers) in a single, compact unit.

In some embodiments a slim triple-band three-sector base station comprising three triple-band antennas, further comprises a modular system to easily modify the height of said slim base station with respect to the floor from approximately 10 wavelengths to approximately 65 wavelengths at the highest frequency of the lowest frequency band of the said antenna arrays, allowing the network operator to tailor the area of coverage of the said slim base station.

In some cases, to facilitate the handling and/or installation of an antenna array, said antenna array might be split into two portions that can be then assembled together one on top of the other. Each portion might comprise in some embodiments approximately a half of the radiating elements of the triple-band antenna array. For example in the case of the antenna array of FIG. 1*a*, the antenna array (100) could be split into a first portion comprising the first and third sets of radiating elements (101, 103) and a second portion comprising the second and fourth sets of radiating elements (102, 104). Some additional connecting means should be provided to said first and second portions of the antenna array to make it possible to assemble (both mechanically and electrically) the two portions into a single triple-band antenna array. Dividing the antenna array into two portions could be advantageous when a slim base station has to be installed on the roof of a building, and the different sections of the structure need to be transported into an elevator or through a staircase.

BRIEF DESCRIPTION OF THE DRAWINGS

Further characteristics and advantages of the invention will become apparent in view of the detailed description which follows of some preferred embodiments of the invention given for purposes of illustration only and in no way meant as a definition of the limits of the invention, made with reference to the accompanying drawings.

In FIGS. 2*a* and 2*c*, the radiating elements are shown in a plan view, while in FIG. 2*b* the radiating element is represented in an azimuthal perspective and housed within a box-type ground-plane.

In FIGS. 4*a* and 4*b*, the radiating elements are shown in perspective, while in FIGS. 4*c* and 4*d* the radiating elements are represented in a plan view.

FIG. 10*a*—three triple-band antenna arrays forming a three-sector configuration with 20 degrees of angular spacing; FIG. 10*b*—three-sector configuration without angular spacing; and FIG. 10*c*—three-sector configuration with 20 degrees of angular spacing and ground-planes with bent flanges.

DETAILED DESCRIPTION

Figures 1A, 1B, 1C, 1D, 1E, 1F, 1G, 1H, 1I, 1J:
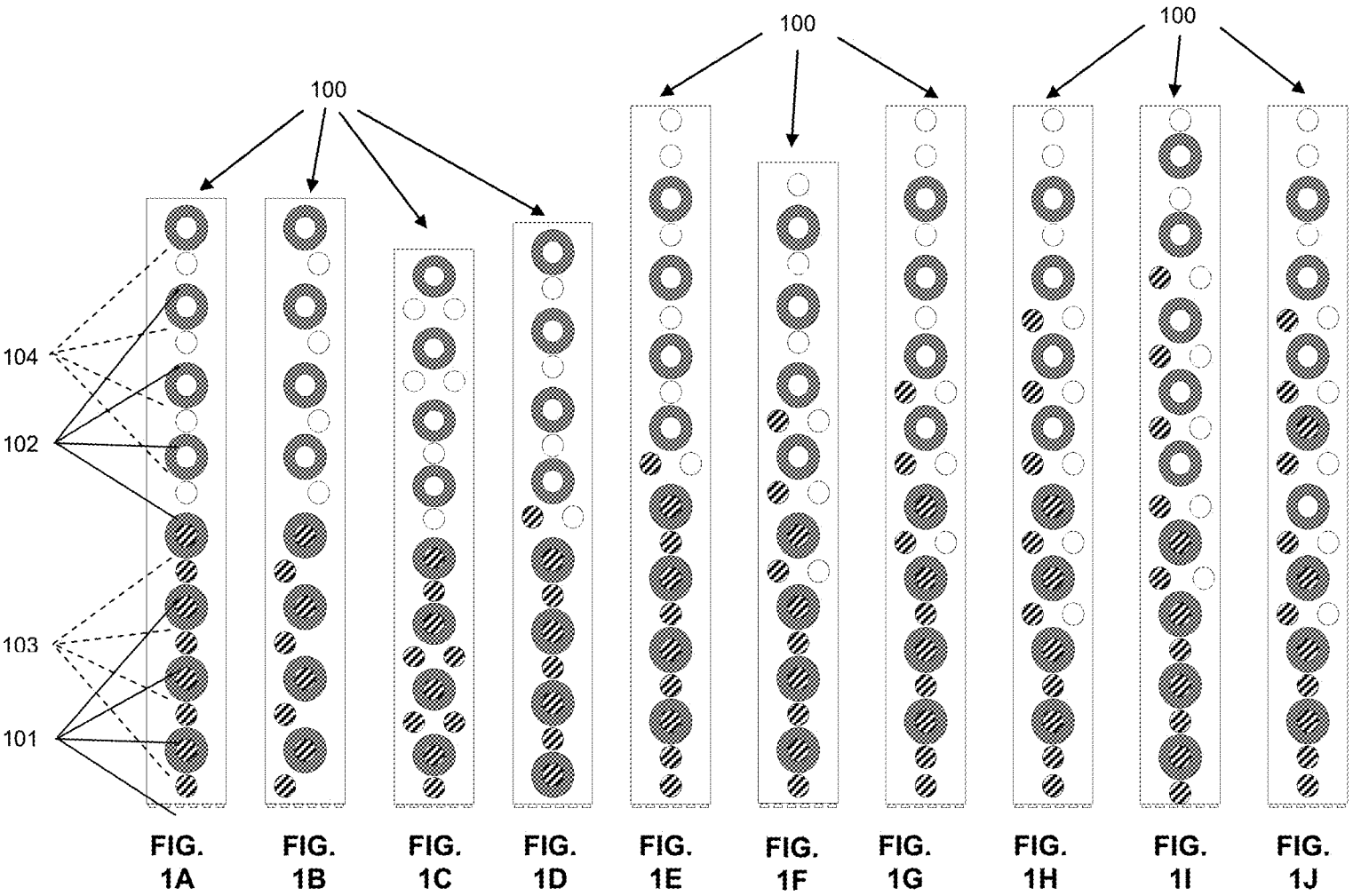
FIGS. 1*a*-1*j* are schematics of some possible arrangements of the radiating elements of a triple-band antenna array.

FIGS. 1*a*-1*j* present, without any limiting purpose, several ways in which the radiating elements of a triple-band antenna array can be arranged according to the present invention. In order to further reduce the size of the triple-band antenna array (100), its radiating elements may be interlaced. In FIGS. 1*a*-1*j*, the circles of different sizes and/or shading indicate the position in the array of the radiating elements belonging to the different sets (101, 102, 103, 104). The radiating elements are depicted as circles for illustration purposes only, and they do not necessarily represent their actual shape. In FIG. 1*a*, the combination of a first set of radiating elements (101) with the third set of radiating elements (103) provides a first frequency band of the antenna array (100). Then, the combination of a second set of radiating elements (102) with the fourth set of radiating elements (104) provides a second frequency band of the antenna array (100). Finally, the combination of the third set of radiating elements (103) with the fourth set of radiating elements (104) provides a third frequency band of the antenna array (100).

In the example of FIG. 1*a*, the radiating elements of the antenna array (100) are arranged in such a way that they are substantially aligned with respect to a vertical axis.

FIGS. 1*b* through 1*j* disclose examples of a triple-band antenna array (100) in which at least some of its radiating elements have been displaced off the central vertical axis of the array (100). For example, in FIG. 1*b* the radiating elements of the first set (101) are shifted to the left side of the array (100), while the radiating elements of the second set (102) are shifted towards the right side of the array (100).

In FIGS. 1*c* through 1*j* at least some elements of the first set (101) and/or the second set (102) are arranged off the central vertical axis of the array.

FIGS. 1*e*, 1*g*, 1*h*, and 1*j* depict cases in which there is at least one pair of adjacent vertically-spaced radiating elements that belong to the same set of radiating elements. See for example, in the lower part of the antenna array (100) two adjacent radiating elements of the first set (101), and in the upper part of the antenna array (100) two adjacent radiating elements of the second set (102).

Figure 2A:
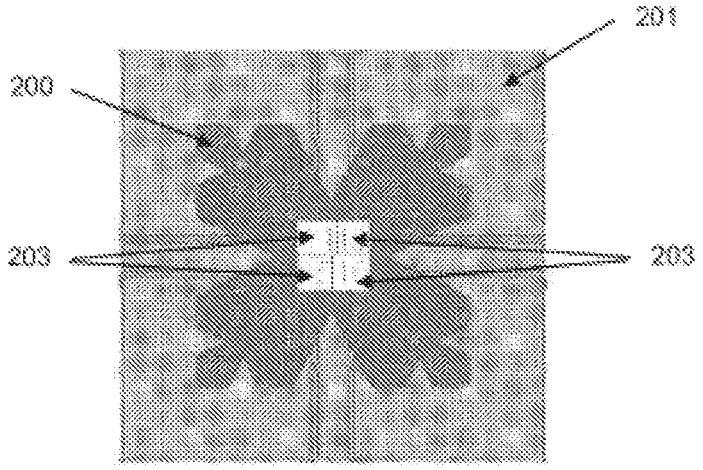
FIGS. 2*a*-2*c* show examples of some embodiments of small radiating elements able to operate in a frequency band.
Figure 2B:
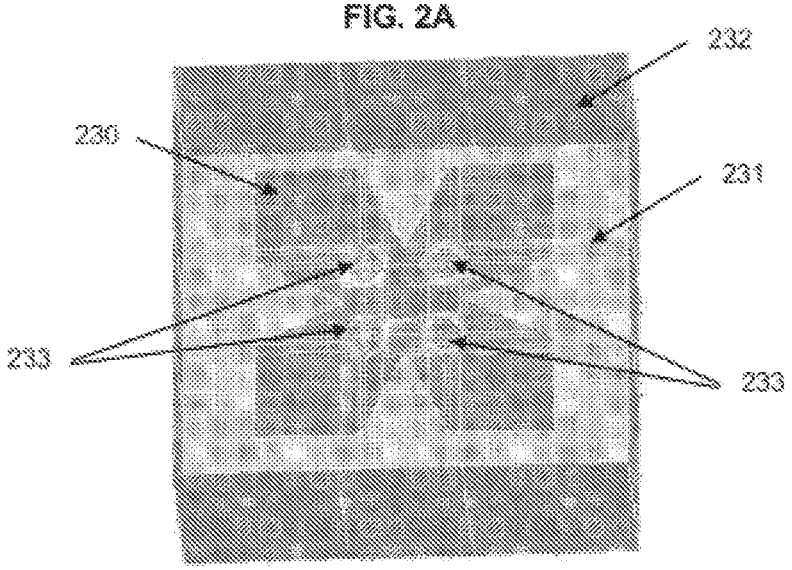
Figure 2C:
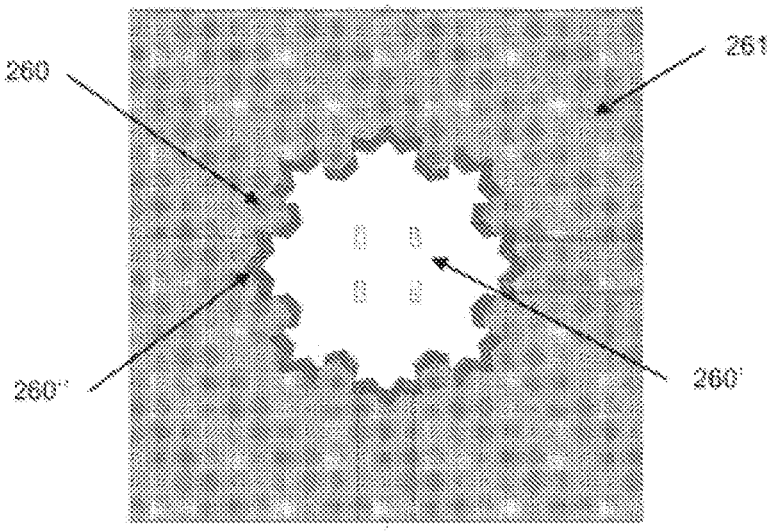

FIG. 2 shows some examples of compact radiating elements that can be used in the slim triple band antenna array. The elements (200, 230, 260) operate at a frequency band, which is preferably within the range of frequencies from approximately 1,700 MHz to approximately 2,170 MHz, and for two orthogonal polarizations. As an example, the radiating elements in FIG. 2 are patch antennas. The radiating element can comprise a parasitic patch (260') in addition to an electrically driven patch (260").

Figure 3A:
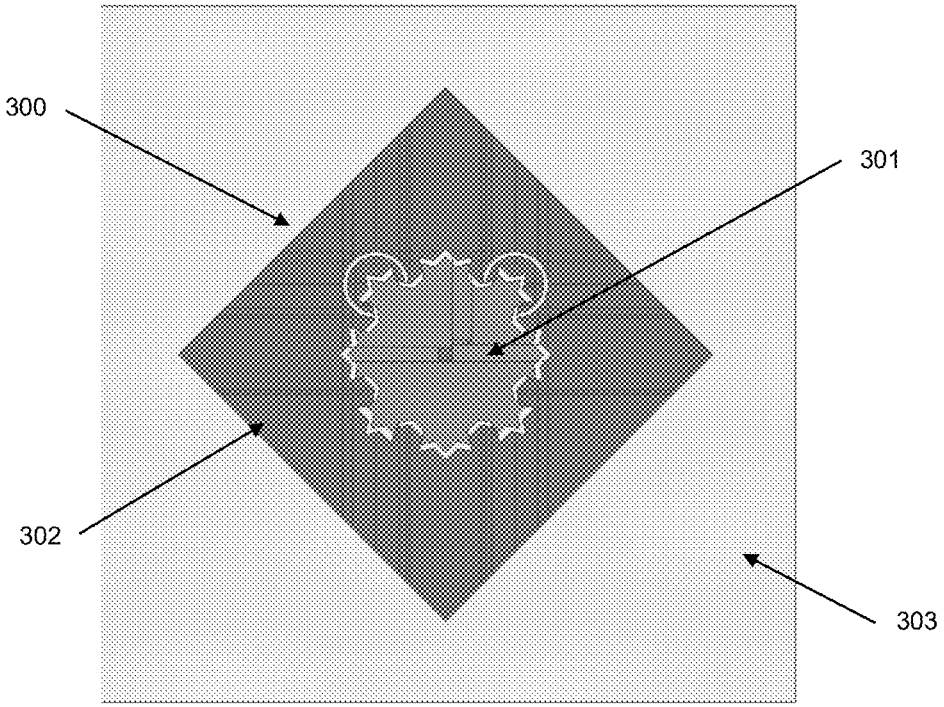
FIG. 3*a* is a schematic plan view and FIG. 3*b* is a schematic elevation view of an example radiating element capable of operating at two different frequency bands and suitable for a slim antenna array.
Figure 3B:
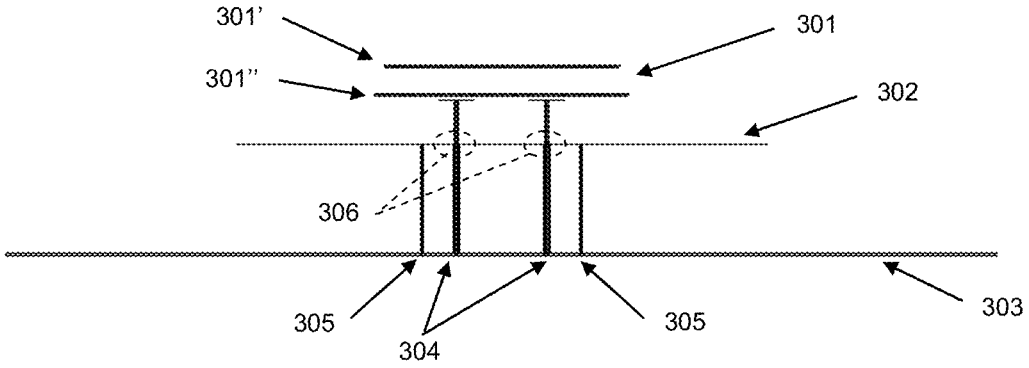

FIG. 3 presents an example of a compact radiating element (300) that can operate at a first frequency band, which is preferably within the range of frequencies from approximately 1,700 MHz to approximately 2,170 MHz, and that can also operate at a second frequency band, which is preferably within the range of frequencies from approximately 700 MHz to approximately 1,000 MHz. Said radiating element (300) comprises a first portion (301), which is mainly responsible for the operation in said first frequency band, mounted on top of a second portion (302), which is mainly responsible for the operation in said second frequency band. Said first portion (301) comprises an electrically driven element (301") and a parasitic element (301').

The radiating element in FIG. 3 has reduced dimensions.

Figure 4A:
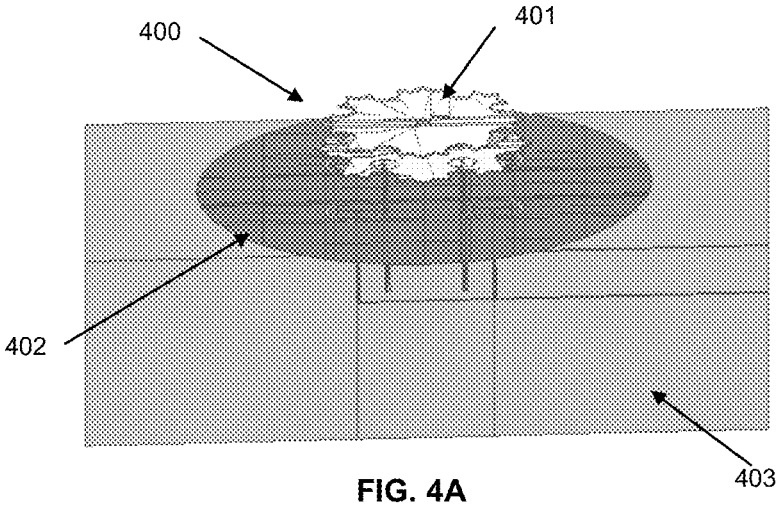
FIGS. 4*a*-4*d* show examples of some embodiments of small radiating elements able to operate in two frequency bands.
Figure 4B:
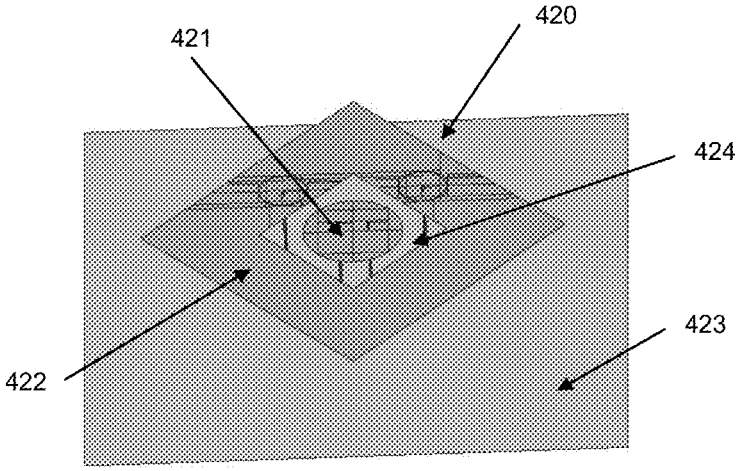

FIGS. 4*a*-4*d* discloses some additional examples of a compact radiating element (400, 420, 440, 460) that can operate at a first frequency band and also at a second frequency band. In FIG. 4*a*, a first portion of the radiating element (401) is stacked on top of a second portion of the said radiating element (402). Alternatively, FIG. 4*b* shows an embodiment in which a first portion of the radiating element (421) is embedded within a second portion of the said radiating element (422). Said second portion (422) presents an aperture or opening (424) within its extent to allow embedding the said first portion (421). A radiating element as the one depicted in FIG. 4*b* can be advantageous in reducing even further the profile of the antenna array.

Figure 4C:
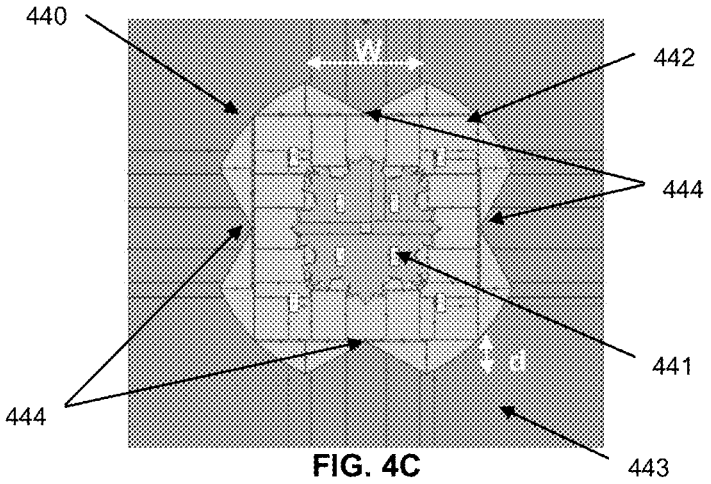
Figure 4D:
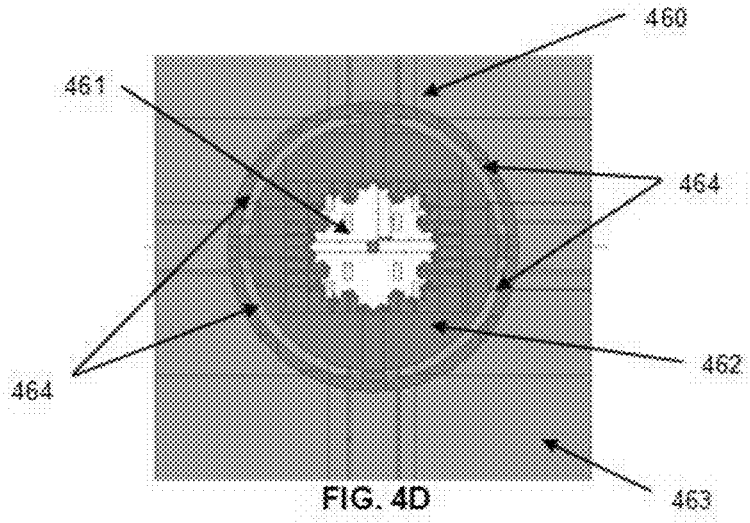

FIGS. 4*c* and 4*d* present two cases of a radiating element (440, 460) in which some indentations or gaps have been created in the second portion of the radiating element (442, 462). Such Indentations (444) or gaps (464) can be advantageous to tailor the radiation properties of the radiating element (440, 460).

In FIG. 4*c*, the indentations (444) have a triangular shape, although other shapes are possible in other examples. Although depicted all being equal, the indentations (444) could have different shapes and/or dimensions.

Although the four gaps (464) are depicted as being equal in FIG. 4*d*, they could have different shapes and/or dimensions, be placed differently on the second portion of the radiating element (462) (such as for example, in a non-symmetrical arrangement), and be fewer or more than four (such as for instance two gaps).

In FIG. 3 and FIG. 4, the radiating element (300, 400, 420, 440, 460) can be excited at eight feeding points. As an example, the first portion of the radiating element (301, 401, 421, 441, 461) is excited with four feeding points, while the second portion of the radiating element (302, 402, 422, 442, 462) is excited independently with four other feeding points. The feeding points can then be combined as explained earlier in this patent application by means of a divider, to obtain a dual-polarized radiating element of four ports (i.e., two orthogonal polarizations for the first frequency band, and two orthogonal polarizations for the second frequency band). For example in the case of the radiating element (300), the conductive posts or pins (304) deliver the electrical signal to the feeding points of the first portion of said element (301). Said posts or pins (304) pass through the second portion of the element (302) by means of gaps practiced in the extent of said second portion (302), and designated by the label (306).

Figure 5A:
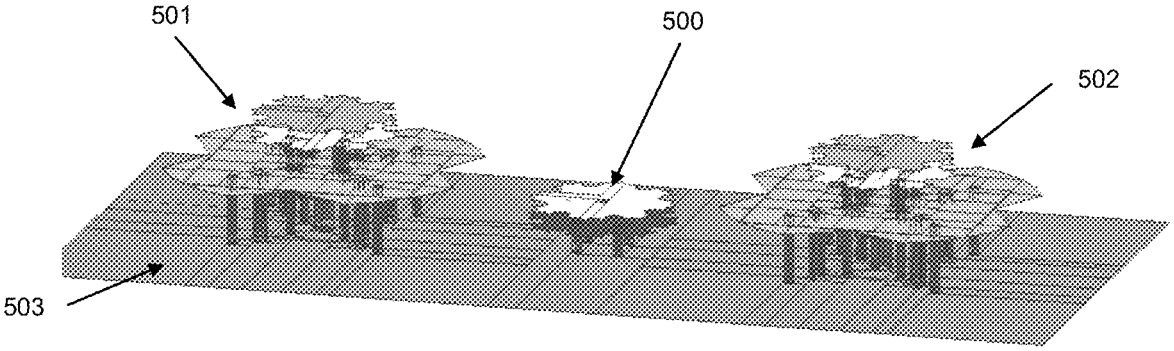
FIG. 5*a* is a schematic perspective and FIG. 5*b* is a plan view of interlaced radiating elements working at different frequency bands.
Figure 5B:
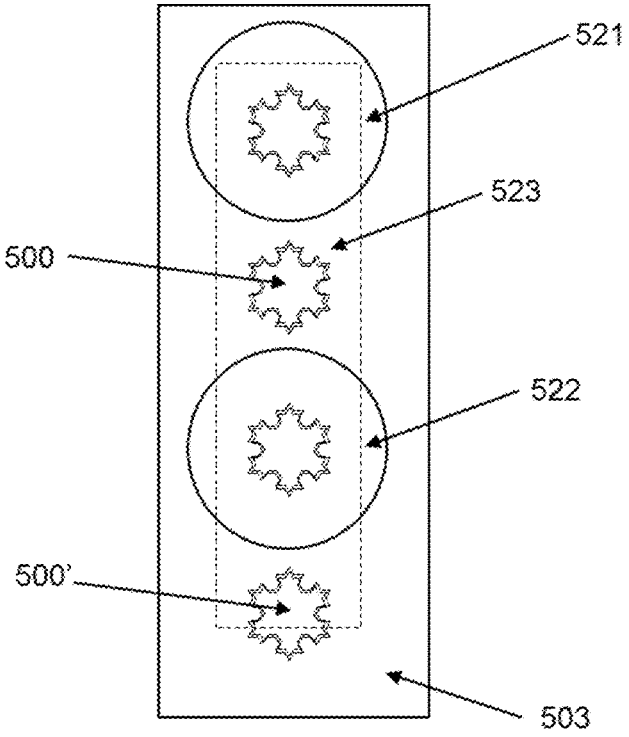
Figure 5C:
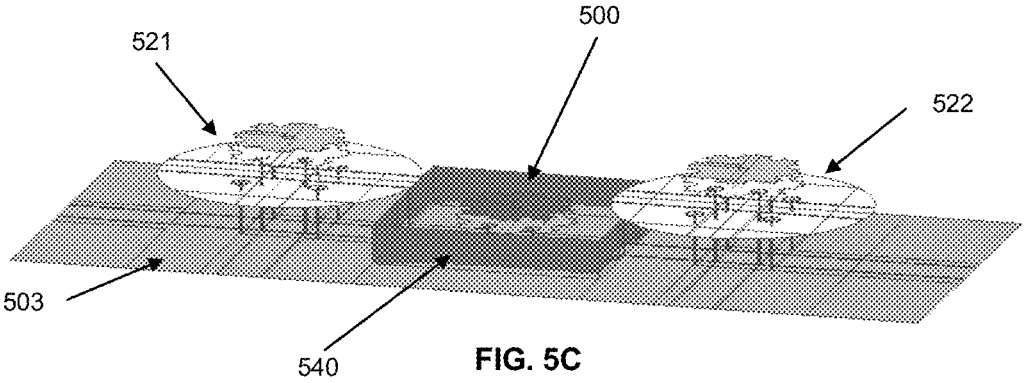
FIG. 5*c* shows an example of an interlaced arrangement of radiating elements in which the central element is placed inside a box-like cavity.
Figure 5D:
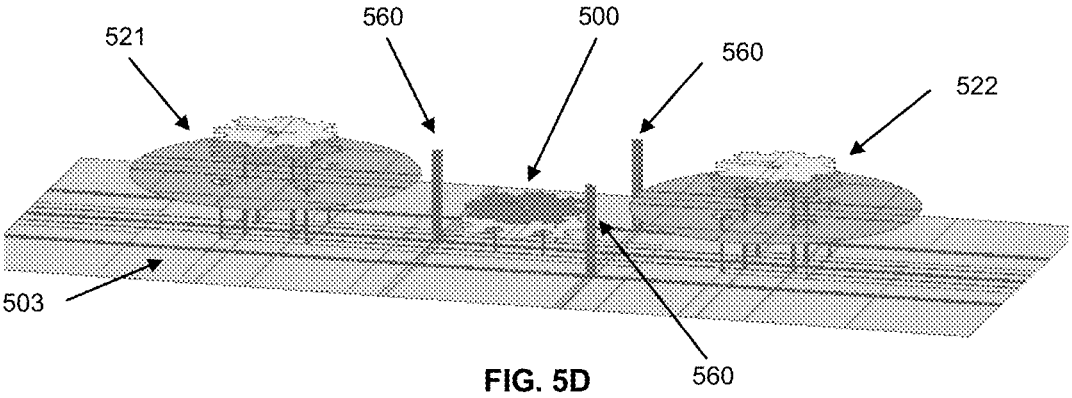
FIG. 5*d* shows an example of an interlaced arrangement of radiating elements in which the central element is surrounded by metal posts.

FIGS. 5*a*, 5*c*, and 5*d* present a schematic perspective view of a portion of an antenna array in which there is one radiating element (500) able to operate in a frequency band within a first range of frequencies, and two radiating elements (501, 502, 521, 522) able to operate in two different frequency bands, one within said first frequency range and another band with a second frequency range. All the radiating elements (500, 501, 502, 521, 522) are mounted on a conductive ground plane (503), and are laid out in an interlaced arrangement.

FIG. 5*b* shows an actual implementation of a portion of an antenna array. The radiating element (500) is located between the radiating element (521) and (522), in this example, the array is completed with another radiating element (500'). As it can be seen in the figure, the four radiating elements are interlaced. Following with this example, the radiating elements (500, 500', 521, 522) are made of a conductive material or alloy, and their fabrication process can comprise the steps of stamping, machining and/or casting. Alternatively in some embodiments according to the present invention, the radiating elements can be made of a layer of a conductive material or alloy printed on, or backed with, a low-loss dielectric substrate (such as for instance Taconic, FR4, Rogers, Arlon, or Neltec). A microstrip distribution network is used to feed the radiating elements (500, 500', 521, 522) with the appropriate signal amplitudes and phases. Said microstrip distribution network is implemented on a dielectric substrate layer (523) placed below the elements (500, 500', 521, 522) and the ground plane (503), and substantially close to the said ground plane (503).

Embodiments such as the ones presented in FIGS. 5*c* and 5*d* can be interesting to enhance the isolation between elements.

FIG. 5*c* shows an embodiment in which at least some of the radiating elements (500) of the antenna array are surrounded by metal walls (or flanges) forming an enclosure (540) around said radiating element (500).

FIG. 5*d* depicts another example in which some conductive posts (560) have been placed between radiating element (521) and (500) (one post in FIG. 1*d*), and also between radiating element (500) and (522) (two posts in FIG. 1*d*).

FIG. 6 discloses, without any limiting purpose, examples in which some flanges are placed at the edges of the ground plane of the antenna array. In the figure, a radiating element (600) is mounted on a ground plane (601). The ground plane (601) comprises a flange (602, 652) at either side that is tilted upwards.

Figure 6A:
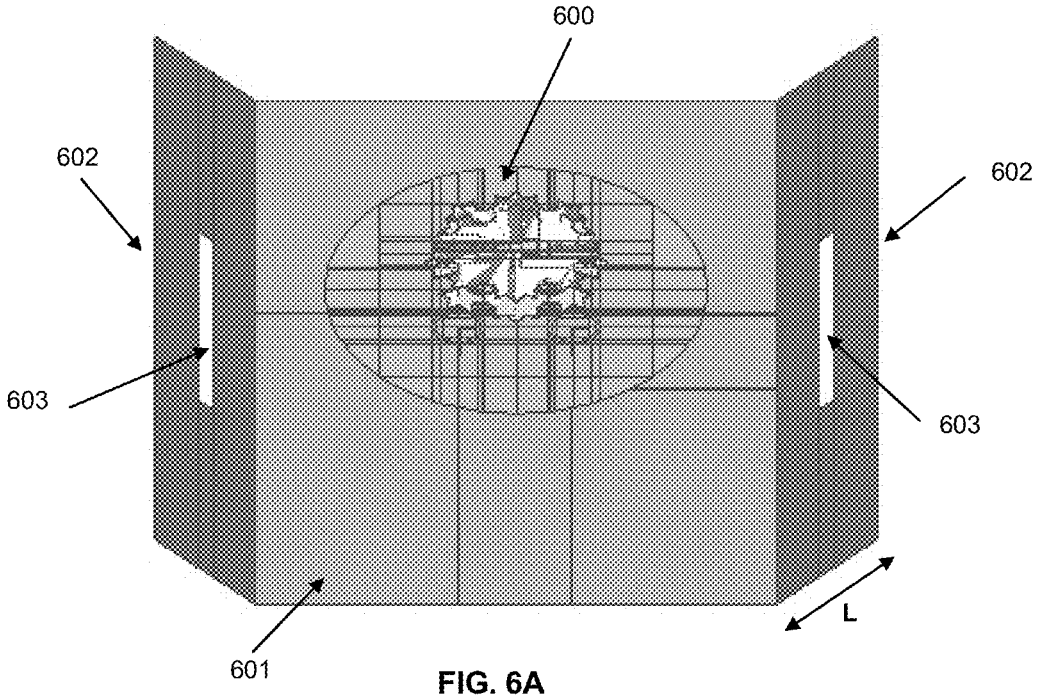
FIG. 6*a* shows an example of a small radiating element able to operate in two frequency bands on a ground plane containing flanges according to the present invention, wherein the flanges of the ground plane including slots.

FIG. 6*a* shows the case in which there is at least one slot (603) on the flange (602). Said slot (603) is advantageously longer than a quarter of the wavelength at the highest frequency of operation of the antenna array, and preferably the slot (603) is located substantially close to a radiating element able to operate in a 10 frequency band within the first range of frequencies (preferably from approximately 1,700 MHz to approximately 2,170 MHz) and in another frequency band within the second range of frequencies (preferably from approximately 700 MHz to approximately 1,000 MHz). More generally, the flange (602) could include more than one slot, gap or opening. Said slots, gaps or openings can have different shape or dimensions, and/or be placed in different locations within the extent of the flange (602).

Figure 6B:
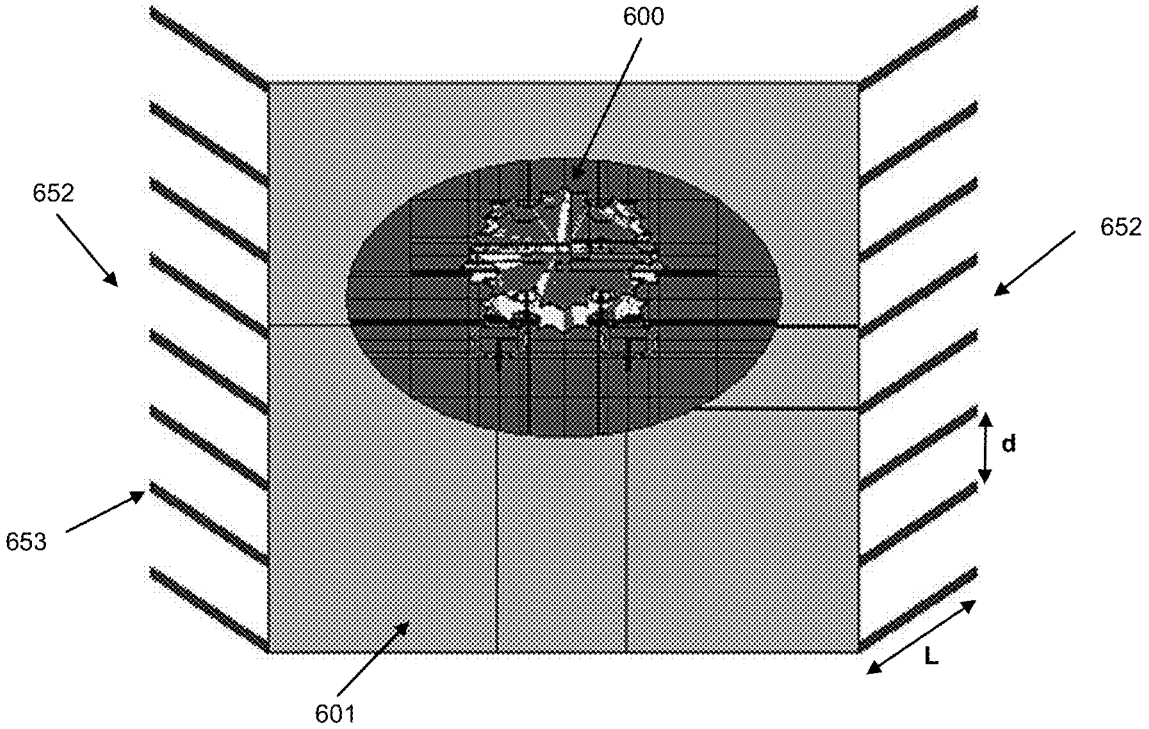
FIG. 6*b* shows an example of a small radiating element able to operate in two frequency bands on a ground plane containing flanges according to the present invention, wherein the flanges of the ground plane are formed by stripes.

FIG. 6*b* represents the case in which the flanges (652) comprise a plurality of conducting stripes (653). Said plurality of conducting stripes (653) are spaced a distance (d) preferably smaller than a quarter of the wavelength at the highest frequency of operation of the antenna array.

Figure 10A:
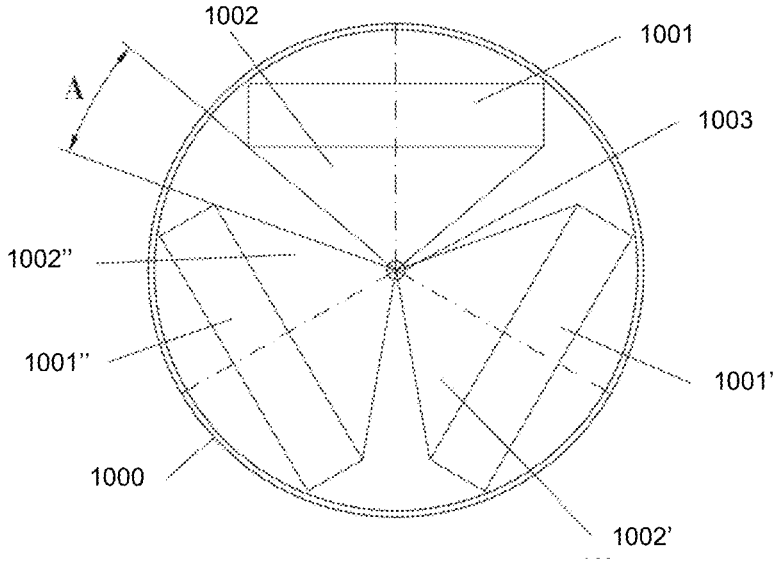
FIGS. 10*a*-10*c* are schematic cross-sectional views of three triple-band antenna arrays housed within a cylindrical radome. The three rectangular shapes represent the antenna arrays in a top view.
Figure 10B:
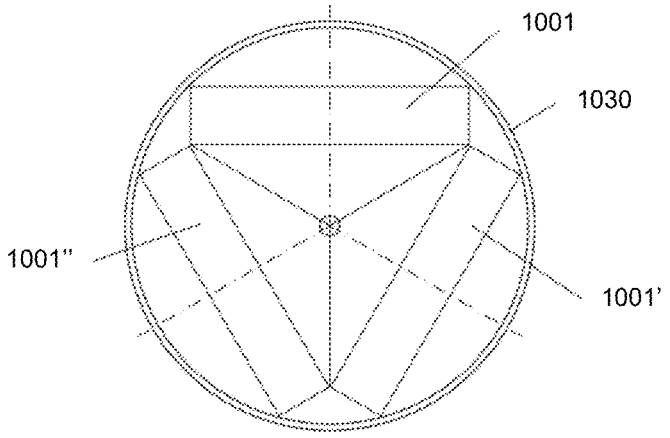
Figure 10C:
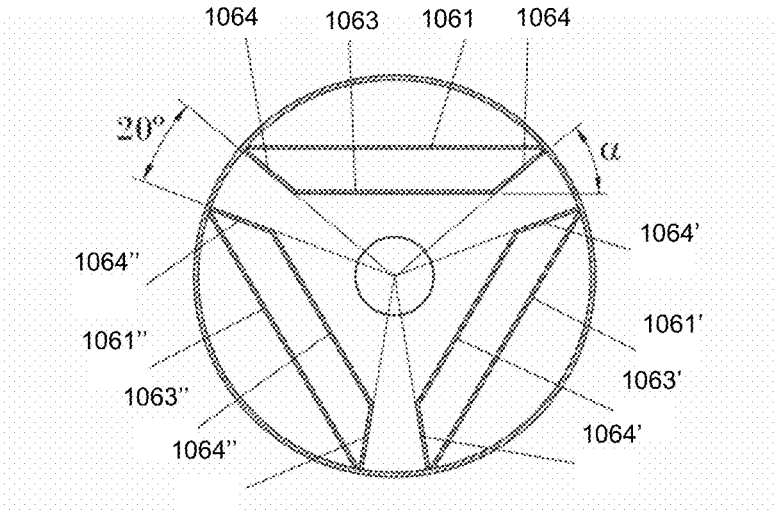

FIGS. 10*a*-10*c* show three antenna arrays (1001, 1001', 1001") radially spaced from a central axis (1003) of the slim base station structure. Each antenna array (1001, 1001, 1001") is respectively placed longitudinally within an angular sector (1002, 1002', 1002") defined around said central axis (1003).

The embodiment of FIG. 10*a* represents a case in which the three angular sectors (1002, 1002', 1002") are less than 120° so that an angular spacing (A) is defined between said angular sectors. Preferably, said angular spacing (A) is within the range from approximately 0° to approximately 30° (with any subinterval included). In the embodiment of FIG. 10*b*, the diameter of the cylindrical radome (1030) is reduced with respect to the embodiment of FIG. 10*a*, for which the three angular sectors (1002, 1002', 1002") extend 120° so that there is no angular spacing (A) in between. The antenna arrays (1001, 1001', 1001") may be in contact at their sides.

FIG. 10*c* is an example of a triple-band antenna array with three independent down-tilt mechanisms and an angular spacing of 20 degrees for each antenna array. In each antenna array (1061, 1061', 1061") the ground plane profile (1063, 1063', 1063") has flanges (1064, 1064', 1064") bent upwards at an optimum angle for minimizing antenna diameter and maximizing aperture of radiation, which is 40 degrees in this example.

In some examples a slim triple-band antenna array includes an adjustable electrical down-tilt mechanism to provide variable down-tilt. Said adjustable electrical down-tilt mechanism comprises phase-shifters.

In a preferred embodiment shown in FIG. 7, the phase shifter is formed by a moveable line (700) mounted on a fix main transmission line (702). The movable line (700) has a "U" shape, but could have another shape featuring two transmission line ends (701, 701') that move together over such main transmission line (702). Preferably, the movable line (700) will have two parallel ends (701, 701') that overlap an interrupted region of the fix main transmission line (702), such that a linear displacement of said movable line (700) introduces a longer electrical path (or a shorter electrical path depending on the direction of said linear displacement) on a whole transmission line set. As shown in FIG. 8, the moveable line (801) is formed by a first substrate (805) provided with a first conductive layer (804), and the fix main transmission line (802) is similarly formed by a second substrate (807) and a second conductive layer (806) on one of its faces. The moveable line (700, 801) slides above the main transmission line (702, 802) and both are separated by respective low friction layers (811, 811') of a low microwave loss material, which could be for instance a Teflon base, to increase durability and avoid passive intermodulation (PIM) at the same time. All parts are sandwiched together with a flexible bridge (803) that acts as a spring to avoid air gaps between layers and so maintaining the proper phase shifting. The bridge (803) is formed by a base (810) fixed for instance to a support (812) of the main transmission line (802). A flexible arm (808) projects horizontally from said base (810) and forms a protuberance (809) at its free end which maintains the moveable line (801) in contact with the main transmission line (802) during its displacement. The bridge (803) acts as a spring due to its shape and the plastic material used. For example, this plastic material can be chosen, without any limiting purpose, from the following set: Polypropylene, Acetal, PVC, and Nylon. This part can be molded for manufacturability and low cost.

Figure 7A:
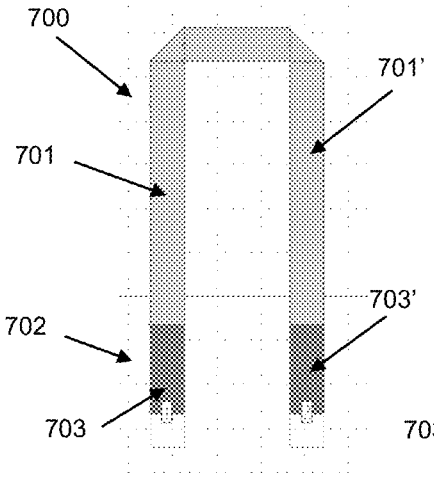
FIG. 7*a* is a schematic plan view of an example of a U-shaped microstrip or strip-line phase shifter with the phase-shifter at its minimum phase position.
Figure 7B:
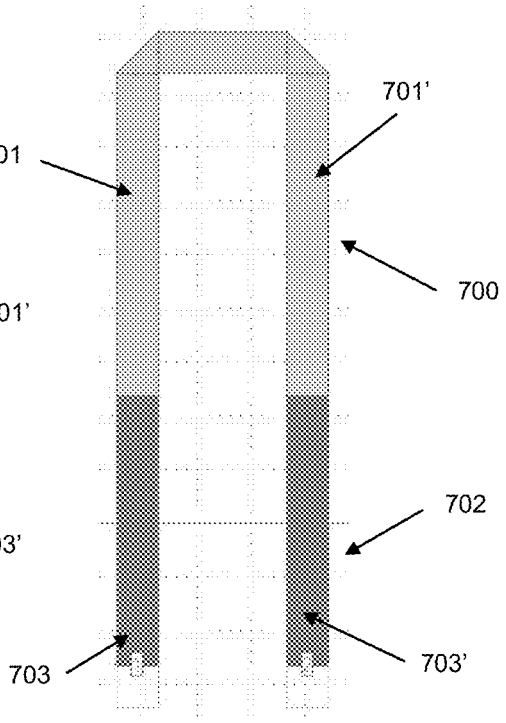
FIG. 7*b* is a schematic plan view of the example of a U-shaped microstrip or strip-line phase shifter with the phase-shifter at its maximum phase position. The moveable transmission line is shown in lighter shading than the fix main transmission line.
Figure 8:
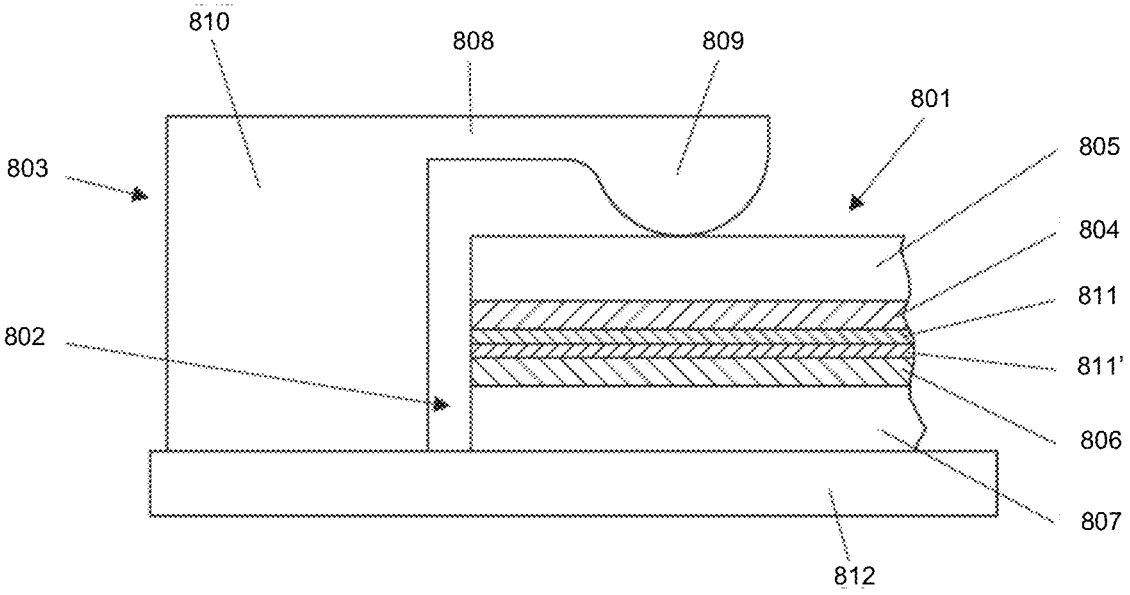
FIG. 8 is an elevation front view of a flexible bridge mounted together with a movable transmission line and a main transmission line.
Figure 9:
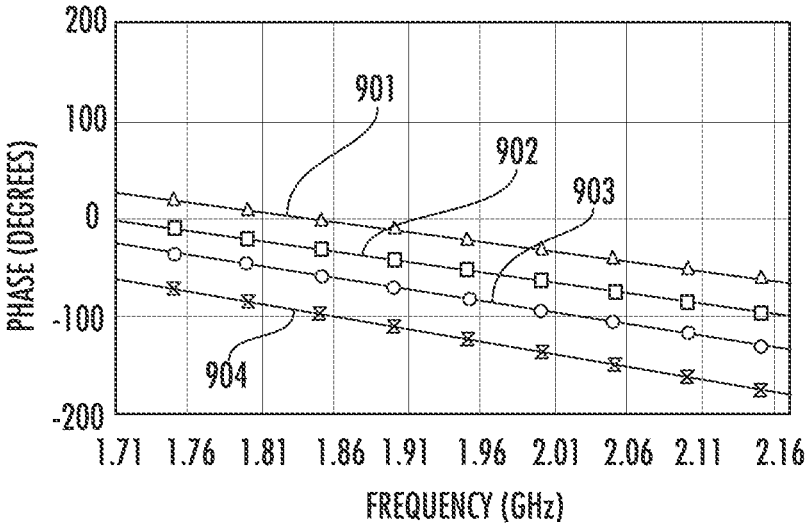
FIG. 9 is a graph presenting the phase progression for different positions of the phase shifter.

FIG. 9 shows the typical phase progression obtained with the phase shifter of FIGS. 7*a* and 7*b* as a function of the frequency and for different positions of the moveable line (700). Curve (901) with triangular markers corresponds to the phase progression obtained when said movable line (700) is in the position shown in FIG. 7*a*, while curve (904) with bowtie markers corresponds to the phase progression obtained when said movable line (700) is in the position shown in FIG. 7*b*. Curve (903) and curve (904) correspond to intermediate positions of said moveable line (700).

Figure 11:
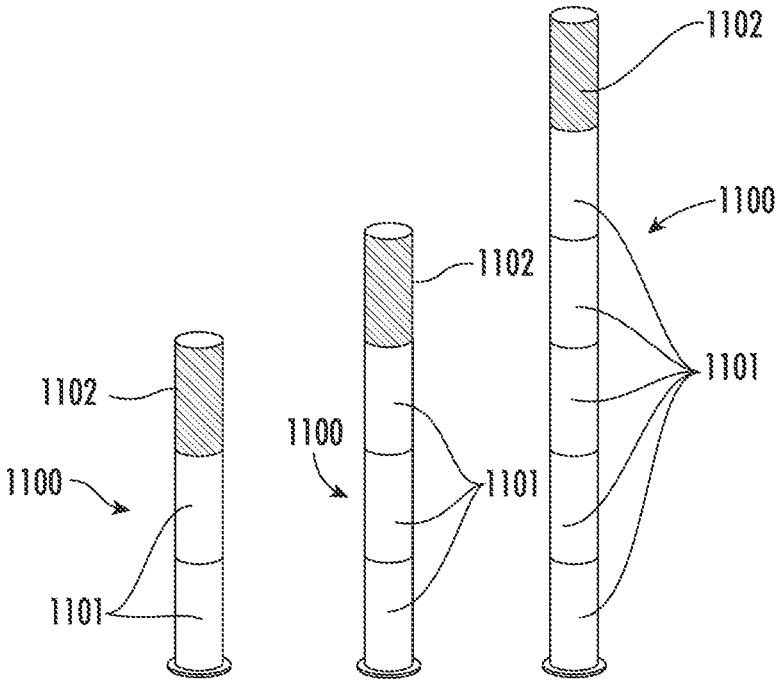
FIG. 11 is a perspective view of a slim triple-band base station wherein the triple-band antenna arrays are mounted on a modular tower, in three different heights from the floor.

Another feature of the slim triple-band antenna array is the integration of the antenna arrays into a slim triple-band base station that is constructed as a modular system to easily modify the height of the antenna array from the floor, as represented in FIG. 11. Such a modular system provides the network operator with means for modifying the height of the antenna array (1102) from the floor to achieve the desired coverage region for the base station. This feature is possible due to the light weight and small profile of the antenna array (1102). More in detail, the slim triple-band antenna arrays are mounted on an elongated tower or support (1100) of adjustable height and preferably of substantially cylindrical shape. The support may be formed by one or more modular support sections (1101) axially coupled together, by means of any technique known in the state of the art and suitable for this purpose. Additionally, the support (1100) may comprise hinge means at its bottom end, so that the support (1100) can be bent to make it easier the installation and the maintenance of the antenna arrays, electronic systems and/or electro-mechanical systems of the base station. Alternatively, the support sections may form a telescopic structure, and the support (1100) can be retracted or extended.

Several techniques are possible to reduce the size of the radiating elements of the antenna array, or parts of the antenna array, within the present invention, such as for instance using space-filling structures, multilevel structures, or box-counting and grid dimension curves. The different geometries are discussed in the following.

About Space Filling Curves

Figure 13:
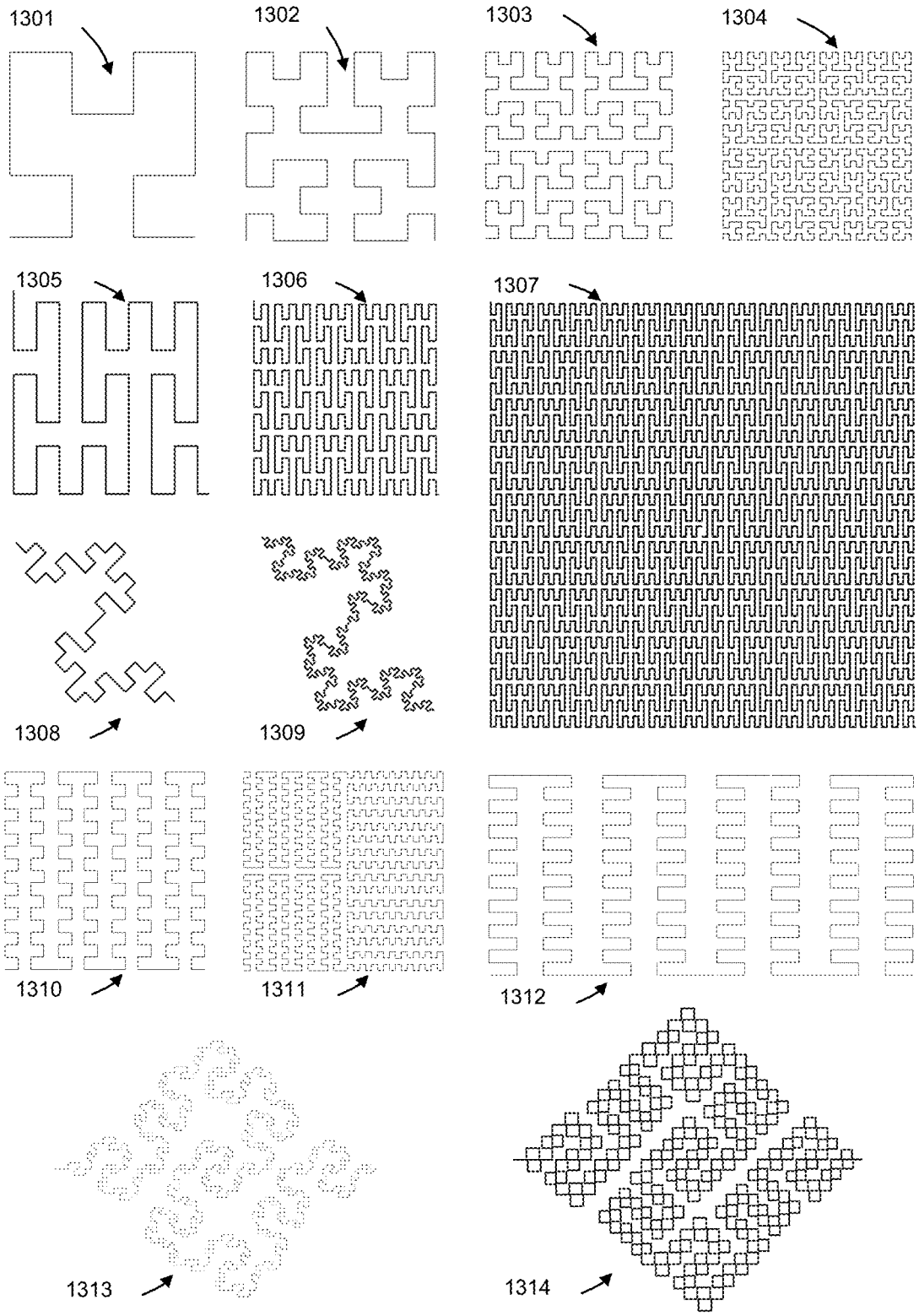
FIG. 13 shows examples (1301-1314) of space filling curves for antenna design.

In some examples, the antenna array, or one or more of the radiating elements of said antenna array, or one or more parts of the antenna array, may be miniaturized by shaping at least a portion of the antenna array (e.g., a part of the arms of a dipole, the perimeter of the patch of a patch antenna, the slot in a slot antenna, the loop perimeter in a loop antenna, or other portions of the antenna array) as a space-filling curve (SFC). Examples of space filling curves are shown in FIG. 13 (see curves 1301 to 1314). A SFC is a curve that is large in terms of physical length but small in terms of the area in which the curve can be included. Space filling curves fill the surface or volume where they are located in an efficient way while keeping the linear properties of being curves. In general space filling curves may be composed of straight, substantially straight and/or curved segments. More precisely, for the purposes of this patent document, a SFC may be defined as follows: a curve having at least a minimum number of segments that are connected in such a way that each segment forms an angle with any adjacent segments, such that no pair of adjacent segments defines a larger straight segment. Possible values for the said minimum number of segments include 5, 6, 7, 8, 10, 12, 14, 16, 18, 20, 25, 30, 35, 40, 45 and 50. In addition, a SFC does not intersect with itself at any point except possibly the initial and final point (that is, the whole curve can be arranged as a closed curve or loop, but none of the lesser parts of the curve form a closed curve or loop).

A space-filling curve can be fitted over a flat or curved surface, and due to the angles between segments, the physical length of the curve is larger than that of any straight line that can be fitted in the same area (surface) as the space-filling curve. Additionally, to shape the structure of a miniature antenna, the segments of the SFCs should be shorter than at least one fifth of the free-space operating wavelength, and possibly shorter than one tenth of the free-space operating wavelength. Moreover, in some further examples the segments of the SFCs should be shorter than at least one twentieth of the free-space operating wavelength. The space-filling curve should include at least five segments in order to provide some antenna size reduction; however, a larger number of segments may be used, such as for instance 10, 15, 20, 25 or more segments. In general, the larger the number of segments and the narrower the angles between them, the smaller the size of the final antenna.

A SFC may also be defined as a non-periodic curve including a number of connected straight, substantially straight and/or curved segments smaller than a fraction of the operating free-space wavelength, where the segments are arranged in such a way that no adjacent and connected segments form another longer straight segment and wherein none of said segments intersect each other.

In one example, an antenna geometry forming a space-filling curve may include at 25 least five segments, each of the at least five segments forming an angle with each adjacent segment in the curve, at least three of the segments being shorter than one-tenth of the longest free-space operating wavelength of the antenna. Preferably each angle between adjacent segments is less than 180° and at least two of the angles between adjacent sections are less than 115°, and at least two of the angles are not equal. The example curve fits inside a rectangular area, the longest side of the rectangular area being shorter than one-fifth of the longest free-space operating wavelength of the antenna. Some space-filling curves might approach a self-similar or self-affine curve, while some others would rather become dissimilar, that is, not displaying self-similarity or self-affinity at all (see for instance 1310, 1311, 1312).

About Box-Counting Curves

In other examples, the antenna array, or one or more of the radiating elements of said antenna array, or one or more parts of the antenna array, may be miniaturized by shaping at least a portion of the antenna array to have a selected box-counting dimension. For a given geometry lying on a surface, the box-counting dimension is computed as follows. First, a grid with rectangular or substantially squared identical boxes of size L1 is placed over the geometry, such that the grid completely covers the geometry, that is, no part of the curve is out of the grid. The number of boxes N1 that include at least a point of the geometry are then counted. Second, a grid with boxes of size L2 (L2 being smaller than L1) is also placed over the geometry, such that the grid completely covers the geometry, and the number of boxes N2 that include at least a point of the geometry are counted. The box-counting dimension D is then computed as:

$$D = -\frac{\log(N2) - \log(N1)}{\log(L2) - \log(L1)}$$

For the purposes of this document, the box-counting dimension may be computed by placing the first and second grids inside a minimum rectangular area enclosing the conducting trace of the antenna and applying the above algorithm. The first grid in general has n×n boxes and the second grid has 2n×2n boxes matching the first grid. The first grid should be chosen such that the rectangular area is meshed in an array of at least 5×5 boxes or cells, and the second grid should be chosen such that L2=½L1 and such that the second grid includes at least 10×10 boxes. The minimum rectangular area is an area in which there is not an entire row or column on the perimeter of the grid that does not contain any piece of the curve. Further the minimum rectangular area preferably refers to the smallest possible rectangle that completely encloses the curve or the relevant portion thereof.

Figures 14A, 14B, 14C:
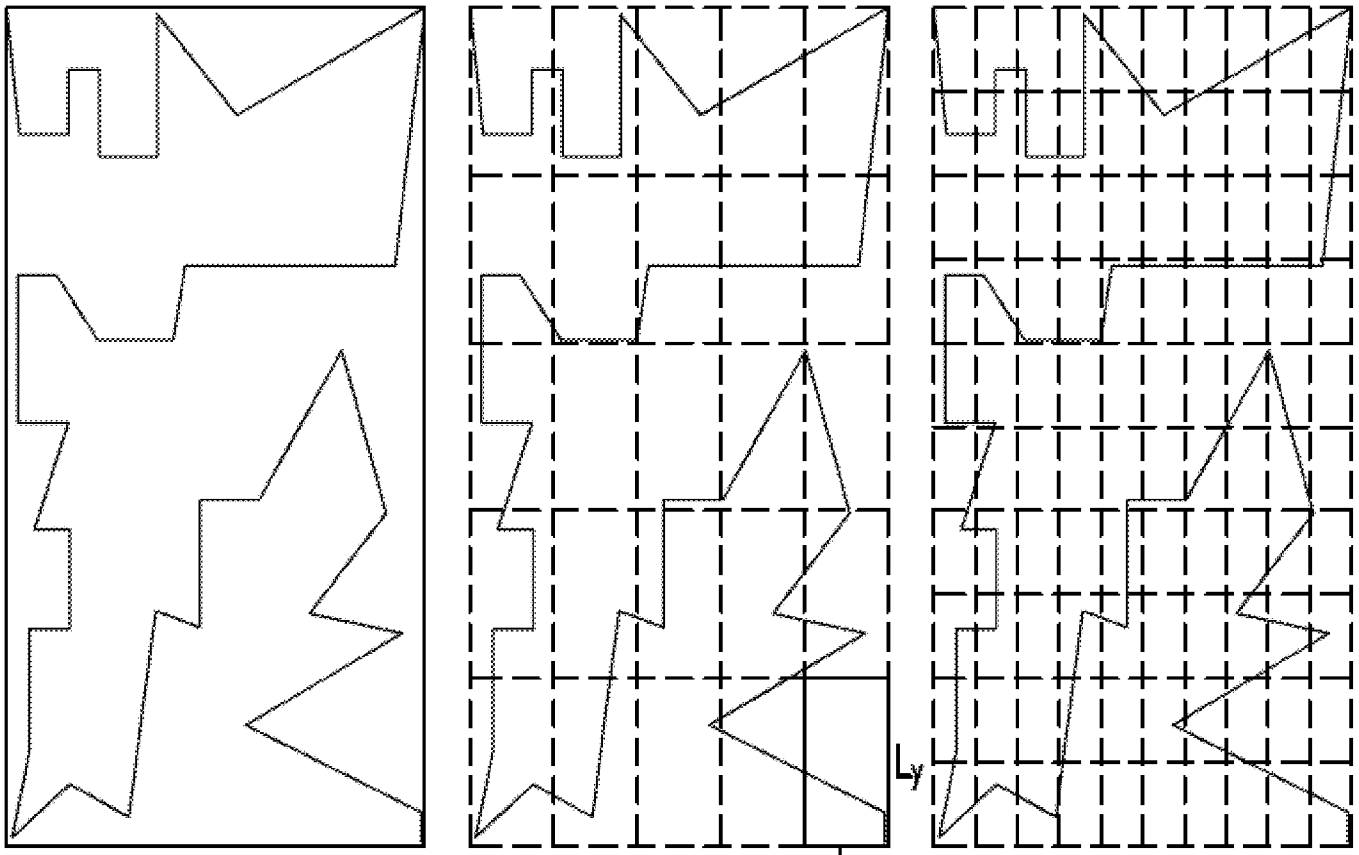
FIGS. 14*a*-14*c* show an example of how to calculate the box counting dimension using a grid of rectangular cells to divide the smallest possible rectangle enclosing the curve.

An example of how the relevant grid can be determined is shown in FIGS. 14*a* to 14*c*. In FIG. 14*a* a box-counting curve is shown in it smallest possible rectangle that encloses that curve. The rectangle is divided in an n×n (here as an example 5×5) grid of identical rectangular cells, where each side of the cells corresponds to 1/n of the length of the parallel side of the enclosing rectangle. However, the length of any side of the rectangle (e.g., Lx or Ly in FIG. 14*b*) may be taken for the calculation of D since the boxes of the second grid (see FIG. 14*c*) have the same reduction factor with respect to the first grid along the sides of the rectangle in both directions (x and y direction) and hence the value of D will be the same no matter whether the shorter (Lx) or the longer (Ly) side of the rectangle is taken into account for the calculation of D. In some rare cases there may be more than one smallest possible rectangle. In this case the smallest possible rectangle giving the smaller value of D is chosen.

Figure 15A:
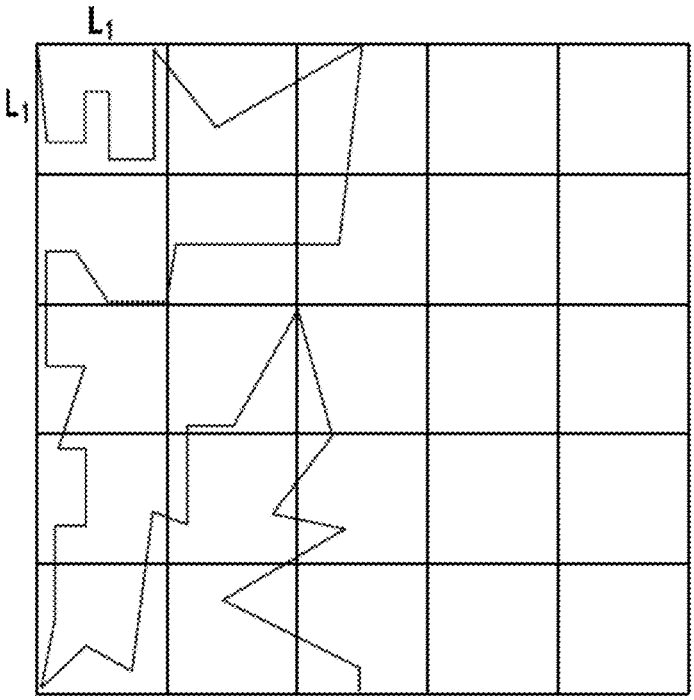
FIGS. 15*a* and 15*b* show an example of how to calculate the box counting dimension using a grid of substantially square cells.
Figure 15B:
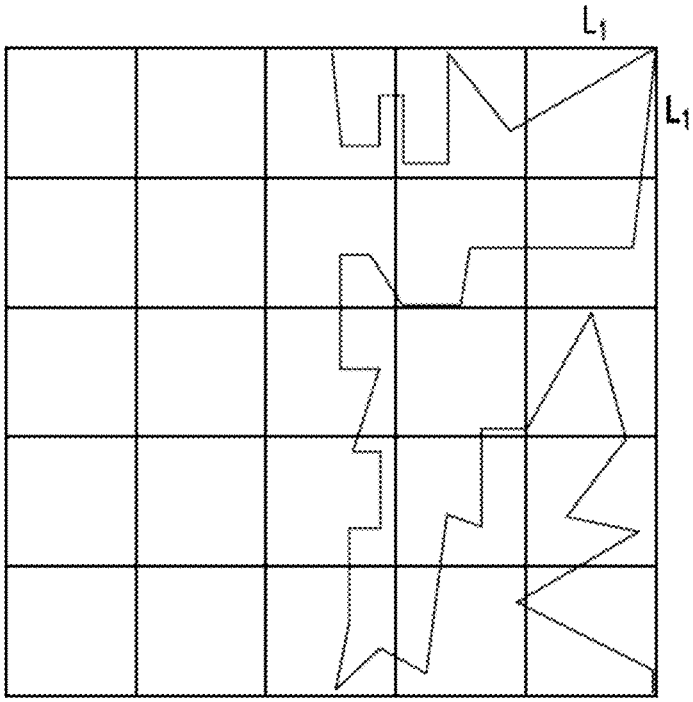

Alternatively the grid may be constructed such that the longer side (see left edge of rectangle in FIG. 14*a*) of the smallest possible rectangle is divided into n equal parts (see L1 on left edge of grid in FIG. 15*a*) and the n×n grid of squared boxes has this side in common with the smallest possible rectangle such that it covers the curve or the relevant part of the curve. In FIG. 15*a* the grid therefore extends to the right of the common side. Here there may be some rows or columns which do not have any part of the curve inside (See the ten boxes on the right hand edge of the grid in FIG. 15*a*). In FIG. 15*b* the right edge of the smallest rectangle (See FIG. 14*a*) is taken to construct the n×n grid of identical square boxes. Hence, there are two longer sides of the rectangular based on which the n×n grid of identical square boxes may be constructed and therefore preferably the grid of the two first grids giving the smaller value of D has to be taken into account.

If the value of D calculated by a first n×n grid of identical rectangular boxes (FIG. 14*b*) inside of the smallest possible rectangle enclosing the curve and a second 2n×2n grid of identical rectangular boxes (FIG. 14*c*) inside of the smallest possible rectangle enclosing the curve and the value of D calculated from a first n×n grid of squared identical boxes (see FIG. 15*a* or 15*b*) and a second 2n×2n grid of squared identical boxes where the grid has one side in common with the smallest possible rectangle, differ, then preferably the first and second grid giving the smaller value of D have to be taken into account.

Alternatively a curve may be considered as a box counting curve if there exists no first n×n grid of identical square or identical rectangular boxes and a second 2n×2n grid of identical square or identical rectangular boxes where the value of D is smaller than 1.1, 1.2, 1.25, 1.3, 1.4, 1.5, 1.6, 1.7, 1.8, 1.9, 2.0, 2.1, 2.2, 2.3, 2.4, 2.5, 2.6, 2.7, 2.8, or 2.9.

In any case, the value of n for the first grid should not be more than 5, 7, 10, 15, 20, 25, 30, 40 or 50.

The desired box-counting dimension for the curve may be selected to achieve a desired amount of miniaturization. The box-counting dimension should be larger than 1.1 in order to achieve some antenna, size reduction. If a larger degree of miniaturization is desired, then a larger box-counting dimension may be selected, such as a box-counting dimension ranging from 1.5 to 2 for surface structures, while ranging up to 3 for volumetric geometries. For the purposes of this patent document, curves in which at least a portion of the geometry of the curve or the entire curve has a box-counting dimension larger than 1.1 may be referred to as box counting curves.

For very small antennas, for example antennas that fit within a rectangle having a maximum size equal to one-twentieth the longest free-space operating wavelength of the antenna, the box-counting dimension may be computed using a finer grid. In such a case, the first grid may include a mesh of 10×10 equal cells, and the second grid may include a mesh of 20×20 equal cells. The grid-dimension (D) may then be calculated using the above equation.

In general, for a given resonant frequency of the antenna, the larger the box-counting dimension, the higher the degree of miniaturization that will be achieved by the antenna.

One way to enhance the miniaturization capabilities of the antenna (that is, reducing size while maximizing bandwidth, efficiency and gain) is to arrange the several segments of the curve of the antenna pattern in such a way that the curve intersects at least one point of at least 14 boxes of the first grid with 5×5 boxes or cells enclosing the curve. If a higher degree of miniaturization is desired, then the curve may be arranged to cross at least one of the boxes twice within the 5×5 grid, that is, the curve may include two non-adjacent portions inside at least one of the cells or boxes of the grid. The relevant grid here may be any of the above mentioned constructed grids or may be any grid. That means if any 5×5 grid exists with the curve crossing at least 14 boxes or crossing one or more boxes twice the curve may be said to be a box counting curve.

Figure 12:
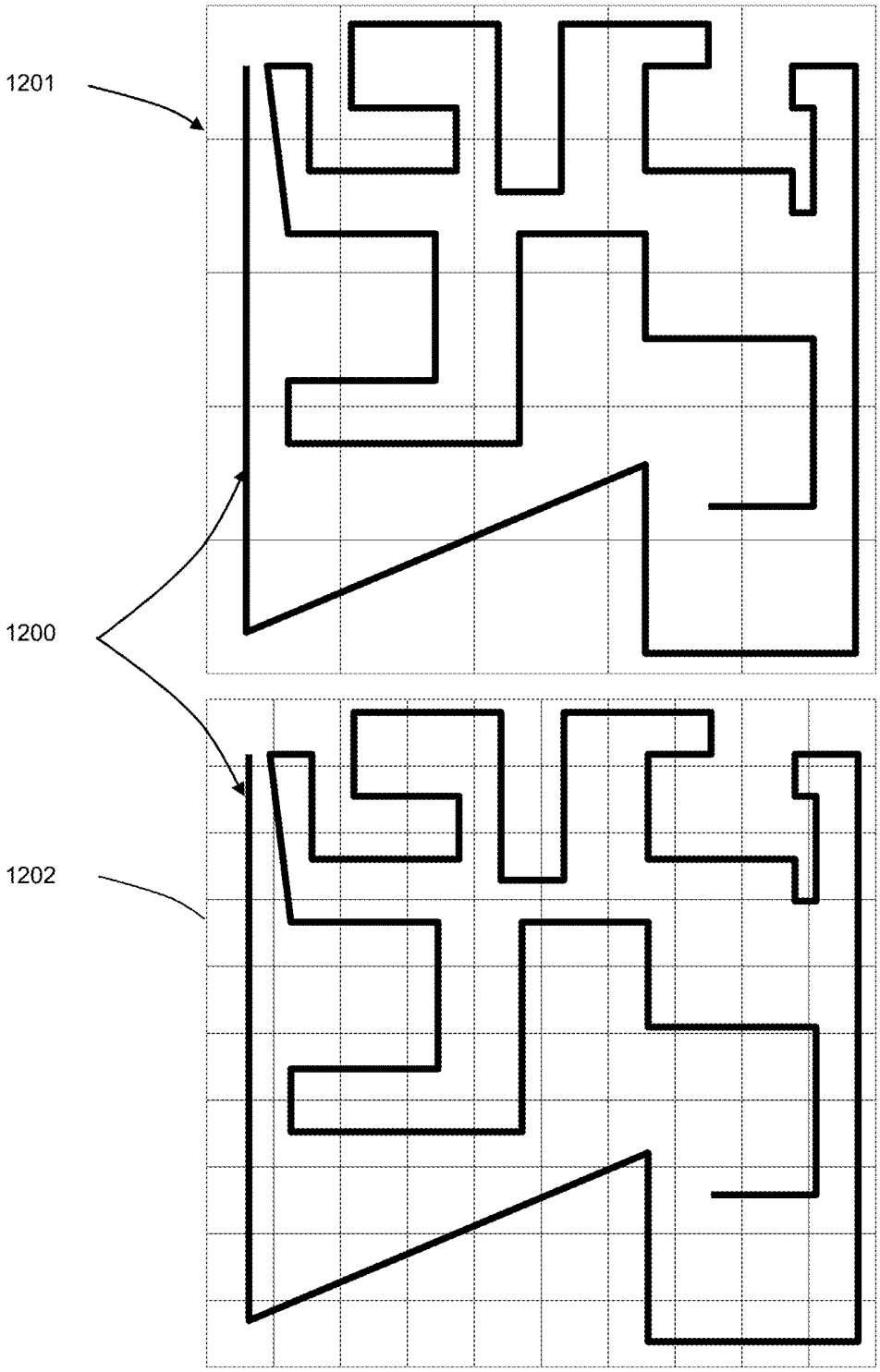
FIG. 12 illustrates an example of how to calculate the box counting dimension.

FIG. 12 illustrates an example of how the box-counting dimension of a curve (1200) is calculated. The example curve (1200) is placed under a 5×5 grid (1201) (FIG. 12 upper part) and under a 10×10 grid (1202) (FIG. 12 lower part). As illustrated, the curve (1200) touches N1=25 boxes in the 5×5 grid (1201) and touches N2=78 boxes in the 10×10 grid (1202). In this case, the size of the boxes in the 5×5 grid 2 is twice the size of the boxes in the 10×10 grid (1202). By applying the above equation, the box-counting dimension of the example curve (1200) may be calculated as D=1.6415. In addition, further miniaturization is achieved in this example because the curve (1200) crosses more than 14 of the 25 boxes in grid (1201), and also crosses at least one box twice, that is, at least one box contains two non-adjacent segments of the curve. More specifically, the curve (1200) in the illustrated example crosses twice in 13 boxes out of the 25 boxes.

The terms explained above can be also applied to curves that extend in three dimensions. If the extension in the third dimension is rather small the curve will fit into an n×n×1 arrangement of 30-boxes (cubes of size L1×L1×L1) in a plane.

Then the calculations can be performed as described above. Here the second grid will be a 2n×2n×1 grid of cuboids of size L2×L2×L1.

If the extension in the third dimension is larger an n×n×n first grid and a 2n×2n×2n second grid will be taken into account. The construction principles for the relevant grids as explained above for two dimensions apply equally in three dimensions.

About Grid Dimension Curves

In yet other examples, the antenna array, or one or more of the radiating elements of said antenna array, or one or more parts of the antenna array, may be miniaturized by shaping at least a portion of the antenna array to include a grid dimension curve. For a given geometry lying on a planar or curved surface, the grid dimension of the curve may be calculated as follows. First, a grid with substantially square identical cells of size L1 is placed over the geometry of the curve, such that the grid completely covers the geometry, and the number of cells N1 that include at least a point of the geometry are counted, Second, a grid with cells of size L2 (L2 being smaller than L1) is also placed over the geometry, such that the grid completely covers the geometry, and the number of cells N2 that include at least a point of the geometry are counted again. The grid dimension D is then computed as:

$$D = -\frac{\log(N2) - \log(N1)}{\log(L2) - \log(L1)}$$

For the purposes of this document, the grid dimension may be calculated by placing the first and second grids inside the minimum rectangular area enclosing the curve of the antenna and applying the above algorithm. The minimum rectangular area is an area in which there is not an entire row or column on the perimeter of the grid that does not contain any piece of the curve.

The first grid may, for example, be chosen such that the rectangular area is meshed in an array of at least 25 substantially equal preferably square cells. The second grid may, for example, be chosen such that each cell of the first grid is divided in 4 equal cells, such that the size of the new cells is L2=½L1, and the second grid includes at least 100 cells.

Depending on the size and position of the squares of the grid, the number of squares of the smallest rectangular may vary. A preferred value of the number of squares is the lowest number above or equal to the lower limit of 25 identical squares that arranged in a rectangular or square grid cover the curve or the relevant portion of the curve. This defines the size of the squares. Other preferred lower limits here are 50, 100, 200, 250, 300, 400 or 500. The grid corresponding to that number in general will be positioned such that the curve touches the minimum rectangular at two opposite sides. The grid may generally still be shifted with respect to the curve in a direction parallel to the two sides that touch the curve. Of such different grids, the one with the lowest value of D is preferred. Also the grid whose minimum rectangular is touched by the curve at three sides (see as an example FIGS. 15*a* and 15*b*) is preferred. The one that gives the lower value of D is preferred here.

The desired grid dimension for the curve may be selected to achieve a desired amount of miniaturization. The grid dimension should be larger than 1 in order to achieve some antenna size reduction. If a larger degree of miniaturization is desired, then a larger grid dimension may be selected, such as a grid dimension ranging from 1.5-3 (e.g., in case of volumetric structures). In some examples, a curve having a grid dimension of about 2 may be desired. For the purposes of this patent document a curve or a curve where at least a portion of that curve is having a grid dimension larger than 1 may be referred to as a grid dimension curve. In some cases, a grid dimension curve will feature a grid dimension D larger than 1.1, 1.2, 1.25, 1.3, 1.4, 1.5, 1.6, 1.7, 1.8, 1.9, 2.0, 2.1, 2.2, 2.3, 2.4, 2.5, 2.6, 2.7, 2.8, or 2.9.

In general, for a given resonant frequency of the antenna, the larger the grid dimension the higher the degree of miniaturization that will be achieved by the antenna.

One example way of enhancing the miniaturization capabilities of the antenna is to arrange the several segments of the curve of the antenna pattern in such a way that the curve intersects at least one point of at least 50% of the cells of the first grid with at least 25 cells (preferably squares) enclosing the curve. In another example, a high degree of miniaturization may be achieved by arranging the antenna such that the curve crosses at least one of the cells twice within the 25 cell grid (of preferably squares), that is, the curve includes two non-adjacent portions inside at least one of the cells or cells of the grid. In general the grid may have only a line of cells but may also have at least 2 or 3 or 4 columns or rows of cells.

Figure 16:
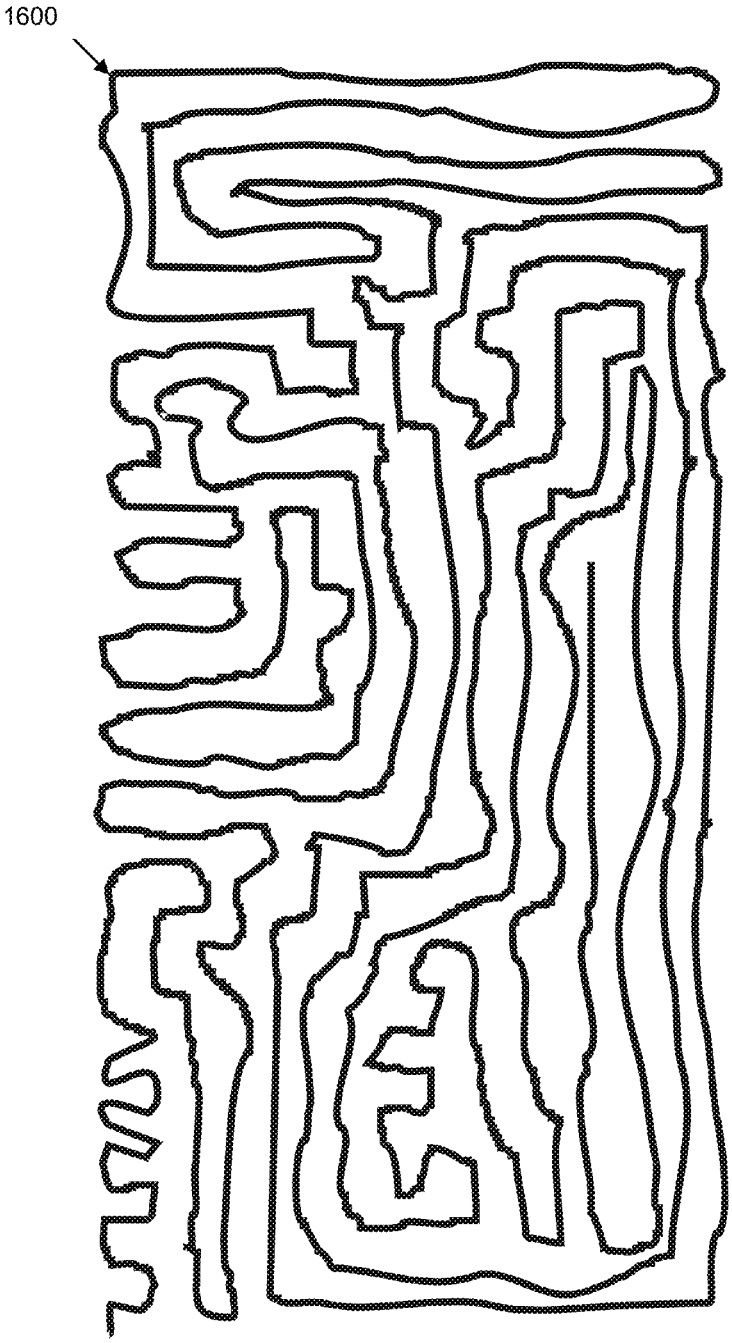
FIG. 16 shows an example of a curve featuring a grid-dimension larger than 1, referred to herein as a grid-dimension curve.
Figure 17:
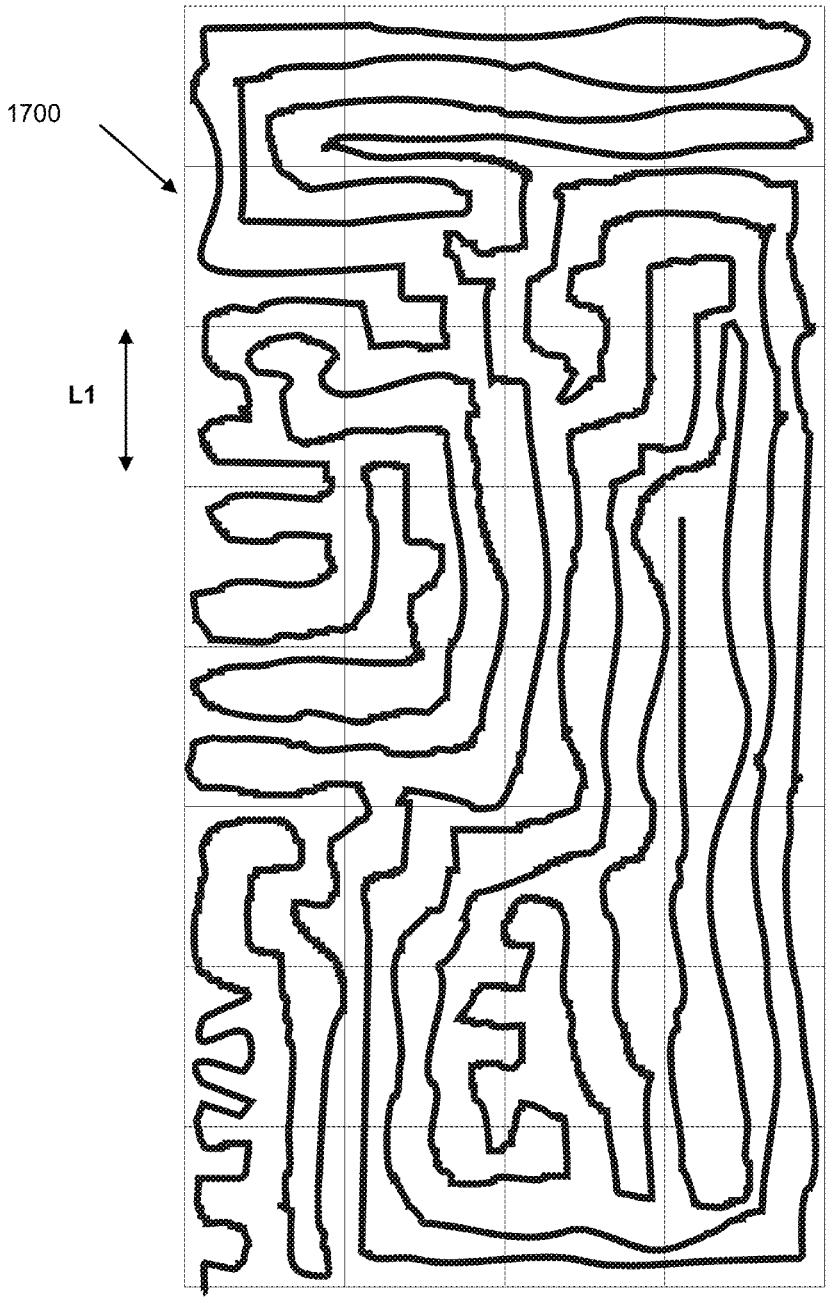
FIG. 17 shows the curve of FIG. 16 in the 32-cell grid, wherein the curve crosses all 32 cells and therefore N1=32.
Figure 18:
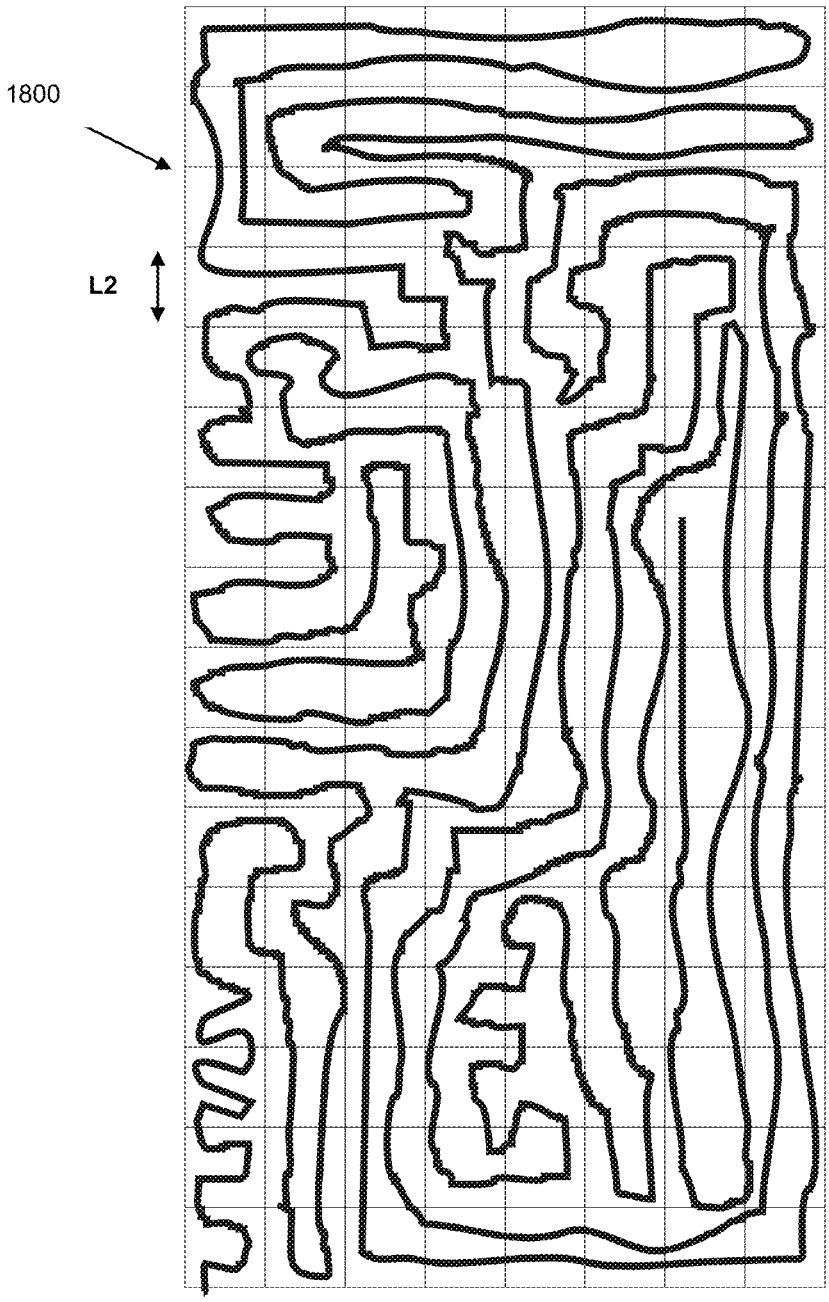
FIG. 18 shows the curve of FIG. 16 in a 128-cell grid, wherein the curve crosses all 128 cells and therefore N2=128.

FIG. 16 shows an example two-dimensional antenna forming a grid dimension curve with a grid dimension of approximately two. FIG. 17 shows the antenna of FIG. 16 enclosed in a first grid having thirty-two (32) square cells, each with a length L1. FIG. 18 shows the same antenna enclosed in a second grid having one hundred twenty-eight (128) square cells, each with a length L2. The length (L1) of each square cell in the first grid is twice the length (L2) of each square cell in the second grid (L1=2×L2). An examination of FIG. 17 and FIG. 18 reveals that at least a portion of the antenna is enclosed within every square cell in both the first and second grids. Therefore, the value of N1 in the above grid dimension (D9) equation is thirty-two (32) (i.e., the total number of cells in the first grid), and the value of N2 is one hundred twenty-eight (128) (i.e., the total number of cells in the second grid). Using the above equation, the grid dimension of the antenna may be calculated as follows:

$$D_g = -\frac{\log(128) - \log(32)}{\log(2 \times L1) - \log(L1)} = 2$$

For a more accurate calculation of the grid dimension, the number of square cells may be increased up to a maximum amount. The maximum number of cells in a grid is dependent upon the resolution of the curve. As the number of cells approaches the maximum, the grid dimension calculation becomes more accurate. If a grid having more than the maximum number of cells is selected, however, then the accuracy of the grid dimension calculation begins to decrease. Typically, the maximum number of cells in a grid is one thousand (1000).

Figure 19:
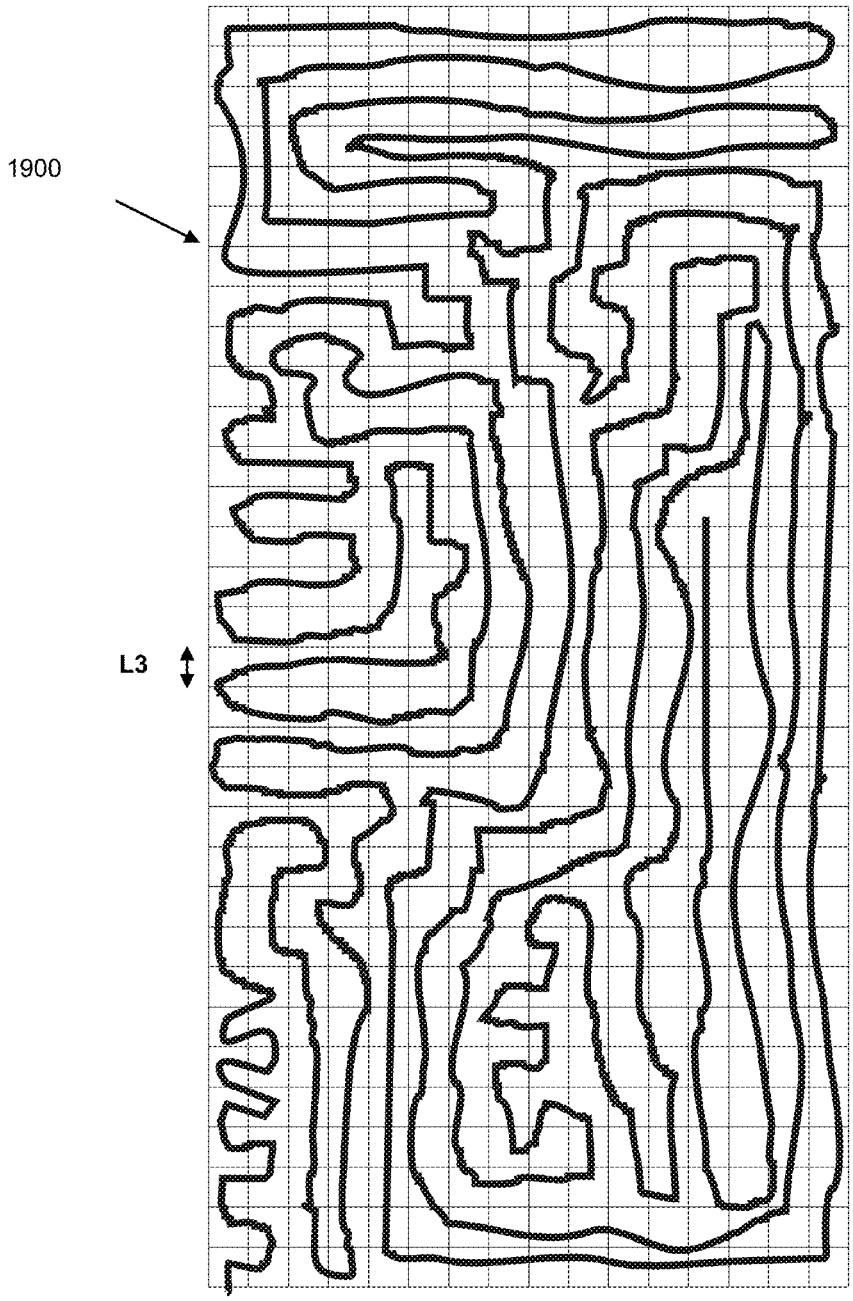
FIG. 19 shows the curve of FIG. 16 in a 512-cell grid, wherein the curve crosses at least one point of 509 cells.
Figure 20:
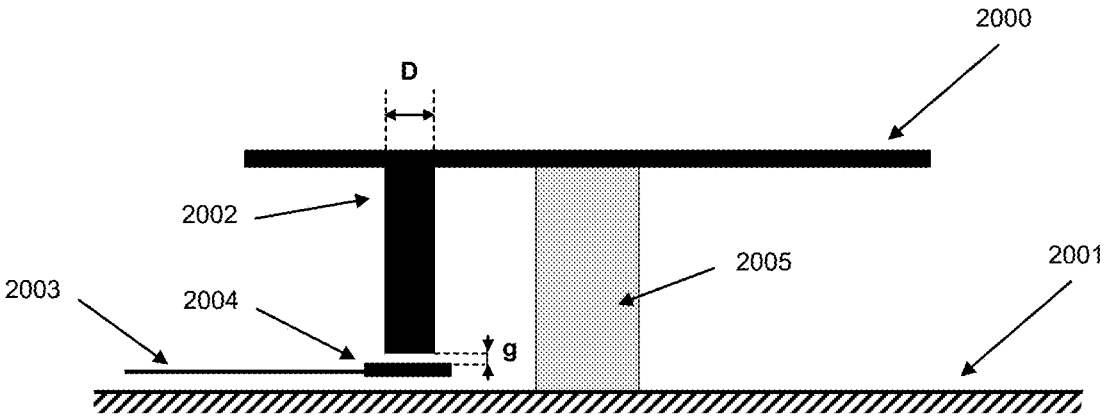
FIG. 20 is an elevation front view showing the detail of the feeding scheme to excite a radiating element by means of capacitive coupling between a conductive cylinder connected to the radiating element and a polygonal pad connected to a transmission line located in the proximity of the ground plane of the antenna array.

For example, FIG. 19 shows the same antenna as of FIG. 16 enclosed in a third grid with five hundred twelve (512) square cells, each having a length L3. The length (L3) of the cells in the third grid is one half the length (L2) of the cells in the second grid, shown in FIG. 18. As noted above, a portion of the antenna is enclosed within every square cell in the second grid, thus the value of N for the second grid is one hundred twenty-eight (128). An examination of FIG. 19, however, reveals that the antenna is enclosed within only five hundred nine (509) of the five hundred twelve (512) cells of the third grid. Therefore, the value of N for the third grid is five hundred nine (509). Using FIG. 18 and FIG. 19, a more accurate value for the grid dimension ($D_g$) of the antenna may be calculated as follows:

$$D_g = -\frac{\log(509) - \log(128)}{\log(2 \times L2) - \log(L2)} \approx 1.9915$$

It should be understood that a grid-dimension curve does not need to include any straight segments. Also, some grid-dimension curves might approach a self-similar or self-affine curves, while some others would rather become dissimilar, that is, not displaying self-similarity or self-affinity at all (see for instance FIG. 16).

The terms explained above can be also applied to curves that extend in three dimensions. If the extension in the third dimension is rather small the curve will fit into an arrangement of 3D-boxes (cubes) in a plane. Then the calculations can be performed as described above. Here the second grid will be composed in the same plane of boxes with the size L2×L2×L1.

If the extension in the third dimension is larger an m×n×o first grid and a 2m×2n×2o second grid will be taken into account. The construction principles for the relevant grids as explained above for two dimensions apply equally in three dimensions. Here the minimum number of cells preferably is 25, 50, 100, 125, 250, 400, 500, 1000, 1500, 2000, 3000, 4000 or 5000.

About Multilevel Structures

In another example, at least a portion of the antenna array may be coupled, either through direct contact or electromagnetic coupling, to a conducting surface, such as a conducting polygonal or multilevel surface. Further the antenna array, or one or more of the radiating elements of said antenna array, or one or more parts of the antenna array, may include the shape of a multilevel structure. A multilevel structure is formed by gathering several geometrical elements such as polygons or polyhedrons of the same type or of different type (e.g., triangles, parallelepipeds, pentagons, hexagons, circles or ellipses as special limiting cases of a polygon with a large number of sides, as well as tetrahedral, hexahedra, prisms, dodecahedra, etc.) and coupling these structures to each other electromagnetically, whether by proximity or by direct contact between elements.

At least two of the elements may have a different size. However, also all elements may have the same or approximately the same size. The size of elements of a different type may be compared by comparing their largest diameter.

The majority of the component elements of a multilevel structure have more than 50% of their perimeter (for polygons) or of their surface (for polyhedrons) not in contact with any of the other elements of the structure. In some examples, said majority of component elements would comprise at least the 50%, 55%, 60%, 65%, 70% or 75% of the geometric elements of the multilevel structure. Thus, the component elements of a multilevel structure may typically be identified and distinguished, presenting at least two levels of detail: that of the overall structure and that of the polygon or polyhedron elements which form it. Additionally, several multilevel structures may be grouped and coupled electromagnetically to each other to form higher level structures. In a single multilevel structure, all of the component elements are polygons with the same number of sides or are polyhedrons with the same number of faces. However, this characteristic may not be true if several multilevel structures of different natures are grouped and electromagnetically coupled to form meta-structures of a higher level.

A multilevel antenna includes at least two levels of detail in the body of the antenna: that of the overall structure and that of the majority of the elements (polygons or polyhedrons) which make it up. This may be achieved by ensuring that the area of contact or intersection (if it exists) between the majority of the elements forming the antenna is only a fraction of the perimeter or surrounding area of said polygons or polyhedrons.

One example property of a multilevel antenna is that the radioelectric behavior of the antenna can be similar in more than one frequency band. Antenna input parameters (e.g., impedance) and radiation patterns remain substantially similar for several frequency bands (i.e., the antenna has the same level of impedance matching or standing wave relationship in each different band), and often the antenna presents almost identical radiation diagrams at different frequencies. The number of frequency bands is proportional to the number of scales or sizes of the polygonal elements or similar sets in which they are grouped contained in the geometry of the main radiating element.

In addition to their multiband behavior, multilevel structure antennae may have a smaller than usual size as compared to other antennae of a simpler structure (such as those consisting of a single polygon or polyhedron). Additionally, the edge-rich and discontinuity-rich structure of a multilevel antenna may enhance the radiation process, relatively increasing the radiation resistance of the antenna and/or reducing the quality factor Q (i.e., increasing its bandwidth).

A multilevel antenna structure may be used in many antenna configurations, such as dipoles, monopoles, patch or microstrip antennae, coplanar antennae, reflector antennae, aperture antennae, antenna arrays, or other antenna configurations. In addition, multilevel antenna structures may be formed using many manufacturing techniques, such as printing on a dielectric substrate by photolithography (printed circuit technique); dieing on metal plate, repulsion on dielectric, or others.

The invention is obviously not limited to the specific embodiment(s) described herein, but also encompasses any variations that may be considered by any person skilled in the art (for example, as regards the choice of materials, dimensions, components, configuration, etc.), within the general scope of the invention as defined in the claims.

What is claimed is:

1. An antenna array comprising:

a first set of radiating elements configured to operate at a first frequency band;

a second set of radiating elements configured to operate at a second frequency band;

a third set of radiating elements configured to operate at the first frequency band and at a third frequency band, the third frequency band not overlapping with the first frequency band and the second frequency band, the first and second sets of radiating elements not being operational at the third frequency band;

a fourth set of radiating elements configured to operate at the second frequency band and at the third frequency band, wherein:

a plurality of the radiating elements of the first set are interlaced with a plurality of the radiating elements of the third set such that a first of the radiating elements of the first set is arranged between first and second radiating elements of the third set, a second of the radiating elements of the first set is arranged between second and third radiating elements of the third set, and a third of the radiating elements of the first set is arranged between third and fourth radiating elements of the third set; and a plurality of the radiating elements of the second set are interlaced with a plurality of the radiating elements of the fourth set such that a first of the radiating elements of the second set is arranged between first and second radiating elements of the fourth set, a second of the radiating elements of the second set is arranged between second and third radiating elements of the fourth set, and a third of the radiating elements of the second set is arranged between third and fourth radiating elements of the fourth set.

2. The antenna array of claim 1, wherein:

a combination of radiating elements of the first set and radiating elements of the third set provides operation of the antenna array at the first frequency band;

a combination of radiating elements of the second set and radiating elements of the fourth set provides operation of the antenna array at the second frequency band; and a combination of radiating elements of the third set and radiating elements of the fourth set provide operation of the antenna array at the third frequency band.

3. The antenna array of claim 1, wherein each of the interlaced radiating elements of the first and third sets is centered on a common axis.

4. The antenna array of claim 3, wherein each of the interlaced radiating elements of the second and fourth sets is centered on the common axis.

5. The antenna array of claim 1, wherein at least three of the interlaced radiating elements of the first and third sets are centered on a common axis and at least one of the interlaced radiating elements of the first and third sets is offset from the common axis.

6. The antenna array of claim 1, wherein at least three of the interlaced radiating elements of the second and fourth sets are centered on a common axis and at least one of the interlaced radiating elements of the second and fourth sets is offset from the common axis.

7. The antenna array of claim 1, wherein the first frequency band includes at least a portion of a frequency range from approximately 1,700 MHz to approximately 2,170 MHz and the second frequency band includes at least a portion of the frequency range from approximately 1,700 MHz to approximately 2,170 MHz.

8. The antenna array of claim 7, wherein the third frequency band includes at least a portion of a frequency range from approximately 700 MHz to approximately 1,000 MHz.

9. The antenna array of claim 1, further comprising:

an electronically adjustable down-tilt mechanism to provide variable down-tilt for at least one of the first, second, and third frequency bands.

10. The antenna array of claim 1, further comprising at least one of: metal walls forming an enclosure around at least one of the radiating elements of the first, second, third, or fourth set of radiating elements; and posts placed between at least two adjacent radiating elements.

11. An antenna array comprising:

a first set of radiating elements configured to operate at a first frequency band;

a second set of radiating elements configured to operate at a second frequency band;

a third set of radiating elements configured to operate at the first frequency band and at a third frequency band, the third frequency band not overlapping with the first frequency band and the second frequency band, the first and second sets of radiating elements not being operational at the third frequency band; and a fourth set of radiating elements configured to operate at the second frequency band and at the third frequency band, wherein:

a plurality of the radiating elements of the first set are interlaced with a plurality of the radiating elements of the third set in an alternating arrangement such that a first of the radiating elements of the third set is arranged between first and second radiating elements of the first set and a second of the radiating elements of the third set is arranged between second and third radiating elements of the first set;

a plurality of the radiating elements of the second set are interlaced with a plurality of the radiating elements of the fourth set in an alternating arrangement such that a first of the radiating elements of the second set is arranged between first and second radiating elements of the fourth set, a second of the radiating elements of the second set is arranged between second and third radiating elements of the fourth set, and a third of the radiating elements of the second set is arranged between third and fourth radiating elements of the fourth set;

at least one of the radiating elements of the first set and the plurality of the radiating elements of the third set are centered on a common axis;

a plurality of metal walls respectively arranged around the plurality of the radiating elements of the first set; and a plurality of metal walls respectively arranged around the plurality of the radiating elements of the second set.

12. The antenna array of claim 11, wherein each of the plurality of the radiating elements of the third set comprises a first portion configured to operate at the first frequency band and a second portion configured to operate at the third frequency band.

13. The antenna array of claim 11, wherein a geometry of the plurality of the radiating elements of the second set is similar to a geometry of the first portion of the plurality of radiating elements of the third set.

14. The antenna array of claim 13, wherein each of the first and second frequency bands provide for two or more cellular or wireless services.

15. The antenna array of claim 14, wherein the third frequency band provides for two or more cellular or wireless services.

16. The antenna array of claim 15, further comprising:

a first electronically adjustable down-tilt mechanism to provide variable down-tilt for the first frequency band;

a second electronically adjustable down-tilt mechanism to provide variable down-tilt for the second frequency band; and a third electronically adjustable down-tilt mechanism to provide variable down-tilt for the third frequency band.

* * * * *